US010411405B2

(12) United States Patent
Obata et al.

(10) Patent No.: US 10,411,405 B2
(45) Date of Patent: Sep. 10, 2019

(54) CONNECTOR MATEABLE WITH AND REMOVEABLE FROM A MATING CONNECTOR BY ROTATION OF A LEVER

(71) Applicant: Japan Aviation Electronics Industry, Limited, Tokyo (JP)

(72) Inventors: Yusuke Obata, Tokyo (JP); Masakazu Kuroiwa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/949,221

(22) Filed: Apr. 10, 2018

(65) Prior Publication Data

US 2019/0013619 A1 Jan. 10, 2019

(30) Foreign Application Priority Data

Jul. 4, 2017 (JP) ..... 2017-130996

(51) Int. Cl.
*H01R 13/629* (2006.01)
*H01R 13/502* (2006.01)
(Continued)

(52) U.S. Cl.
CPC ... *H01R 13/62938* (2013.01); *H01R 13/5025* (2013.01); *H01R 13/62944* (2013.01);
(Continued)

(58) Field of Classification Search
CPC ..... H01R 13/62933; H01R 13/62938
(Continued)

(56) References Cited

U.S. PATENT DOCUMENTS 7,011,536 B2 * 3/2006 Okamoto ..... H01R 13/62911 439/157
7,597,569 B2 10/2009 Okuda et al.
(Continued)

FOREIGN PATENT DOCUMENTS

EP 2 889 966 A1 7/2015
GB 2 300 767 A 11/1996
(Continued)

OTHER PUBLICATIONS

European Search Report in EP 18170514.6-1201, dated Oct. 11, 2018.

*Primary Examiner* — Tulsidas C Patel
*Assistant Examiner* — Marcus E Harcum
(74) *Attorney, Agent, or Firm* — Collard & Roe, P.C.

(57) ABSTRACT

A connector comprising a housing and a lever. The connector is mateable with and removable from a mating connector along a first direction by operation of the lever. The housing has an inner portion, an outer portion, at least one coupling portion, a pivot, a first portion and a second portion. The housing has a lever accommodating portion between the outer portion and the inner portion in a second direction perpendicular to the first direction. The lever accommodating portion partially accommodates the lever. The pivot is positioned inside the lever accommodating portion. The pivot supports the lever so that the lever is rotatable. The at least one coupling portion has a bridge portion which is elastically deformable. The bridge portion is sandwiched between the first portion and the second portion in a plane perpendicular to the second direction.

12 Claims, 16 Drawing Sheets

(51) Int. Cl.
*H01R 13/506* (2006.01)
*H01R 43/00* (2006.01)

(52) U.S. Cl.
CPC ..... *H01R 13/506* (2013.01); *H01R 13/62955* (2013.01); *H01R 13/62977* (2013.01); *H01R 43/00* (2013.01)

(58) Field of Classification Search
USPC ..... 439/372, 157
See application file for complete search history.

(56) References Cited

U.S. PATENT DOCUMENTS 7,931,483 B2 * 4/2011 Komiyama ..... H01R 13/62977 439/157
8,221,142 B2 * 7/2012 Sakamaki ..... H01R 13/62955 439/157
8,439,695 B2 * 5/2013 Komiyama ..... H01R 13/62944 439/157
9,048,579 B2 6/2015 Itou et al.
2006/0040536 A1 2/2006 Putnam et al.
2007/0010113 A1 * 1/2007 Fukatsu ..... H01R 13/62938 439/157
2008/0032531 A1 * 2/2008 Okuda ..... H01R 13/62955 439/157
2009/0263998 A1 * 10/2009 Epe ..... H01R 13/506 439/157
2010/0323537 A1 * 12/2010 Vasbinder ..... H01R 13/62922 439/65
2011/0021048 A1 * 1/2011 Sakamaki ..... H01R 13/4361 439/157
2011/0034049 A1 * 2/2011 Shishikura ..... H01R 13/62944 439/157
2012/0302086 A1 * 11/2012 Oiri ..... H01R 13/62944 439/372
2013/0252446 A1 * 9/2013 Forell ..... H01R 13/62938 439/157

FOREIGN PATENT DOCUMENTS

JP 2006-331991 A 12/2006
JP 2008-204718 A 9/2008
JP 2012-248356 A 12/2012
JP 2013-048020 A 3/2013
JP 5846105 B2 1/2016

* cited by examiner

CONNECTOR MATEABLE WITH AND REMOVEABLE FROM A MATING CONNECTOR BY ROTATION OF A LEVER

CROSS REFERENCE TO RELATED APPLICATIONS

This application is based on and claims priority under 35 U.S.C. § 119 to Japanese Patent Application No. JP2017-130996 filed Jul. 4, 2017, the contents of which are incorporated herein in their entirety by reference.

BACKGROUND OF THE INVENTION

This invention relates to a connector mateable with and removable from a mating connector by rotation of a lever.

Referring to FIGS. 31 and 32, JP-A 2008-204718 (Patent Document 1) discloses a connector 900 comprising a housing 910 and a lever 920. The housing 910 is provided with a lever accommodating portion 912 and a bearing 914, or a pivot 914. The lever accommodating portion 912 partially accommodates the lever 920. The pivot 914 is positioned inside the lever accommodating portion 912. The lever 920 is supported by the pivot 914 so as to be rotatable around the pivot 914. The connector 900 is mateable with and removable from a mating connector 950 along an up-down direction, or along a Z-direction, by operation of the lever 920.

SUMMARY OF THE INVENTION

In an assembly process of a connector having a lever similar to the connector 900 of Patent Document 1, the lever is pushed into a lever accommodating portion while an outer wall of a housing is pushed outward, so that the lever is attached into the housing. Accordingly, in order to easily attach the lever into the housing, it is preferable that the outer wall of the housing is deformable. However, because the lever is easily detached from the housing, it is unfavorable that the outer wall of the housing is excessively deformable after the lever is attached into the housing.

It is therefore an object of the present invention to provide a connector having a structure which enables a lever to be easily attached into a housing in an assembly process of the connector and which prevents the lever from being easily detached from the housing after the attachment of the lever into the housing.

One aspect of the present invention provides a connector comprising a housing and a lever. The connector is mateable with and removable from a mating connector along a first direction by operation of the lever. The housing has an inner portion, an outer portion, at least one coupling portion, a pivot, a first portion and a second portion. The outer portion is provided with at least one outer coupled portion. In a second direction perpendicular to the first direction, the outer portion is positioned away from the inner portion while being positioned outward beyond the inner portion. The housing has a lever accommodating portion between the outer portion and the inner portion in the second direction. The lever accommodating portion partially accommodates the lever. The pivot is positioned inside the lever accommodating portion. The pivot supports the lever so that the lever is rotatable. The inner portion is provided with at least one inner coupled portion. In the second direction, each of the first portion and the second portion is positioned away from the outer portion while being positioned inward beyond the outer portion. The at least one coupling portion couples the at least one outer coupled portion and the at least one inner coupled portion with each other. The at least one coupling portion has a bridge portion which is elastically deformable. In the second direction, the bridge portion is positioned away from the outer portion while being positioned inward beyond the outer portion. The bridge portion is sandwiched between the first portion and the second portion in a plane perpendicular to the second direction. The first portion is a through hole.

In the connector of the present invention, the inner portion and the outer portion are coupled by the coupling portion. Additionally, in the second direction, each of the bridge portion, the first portion and the second portion is positioned away from the outer portion while being positioned inward beyond the outer portion. Furthermore, the bridge portion of the coupling portion is sandwiched between the first portion and the second portion in the plane perpendicular to the second direction. Accordingly, the outer portion is allowed to be deformed outward in the second direction by utilizing deformation of the bridge portion, while the outer portion is prevented from being excessively deformed. Thus, the lever is easily attached into the housing in an assembly process of the connector, while the lever is prevented from being easily detached from the housing after being attached into the housing.

Figure 1:
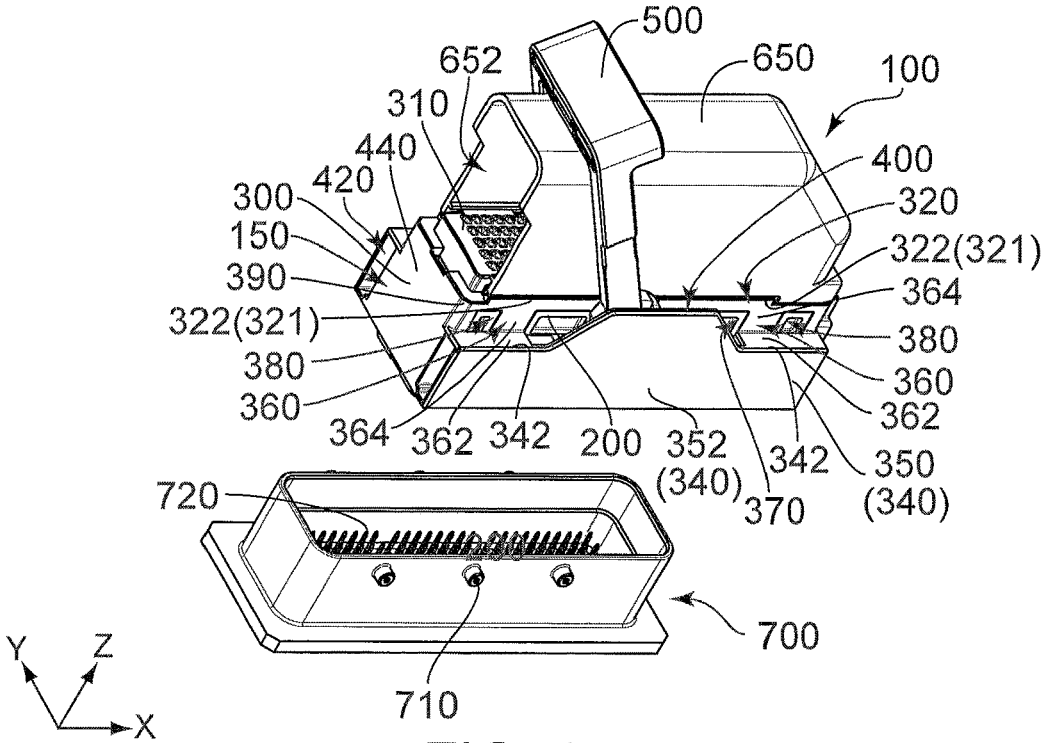
FIG. 1 is a perspective view showing a connector and a mating connector according to an embodiment of the present invention, wherein the connector and the mating connector are not mated with each other and a lever of the connector is positioned at a first position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
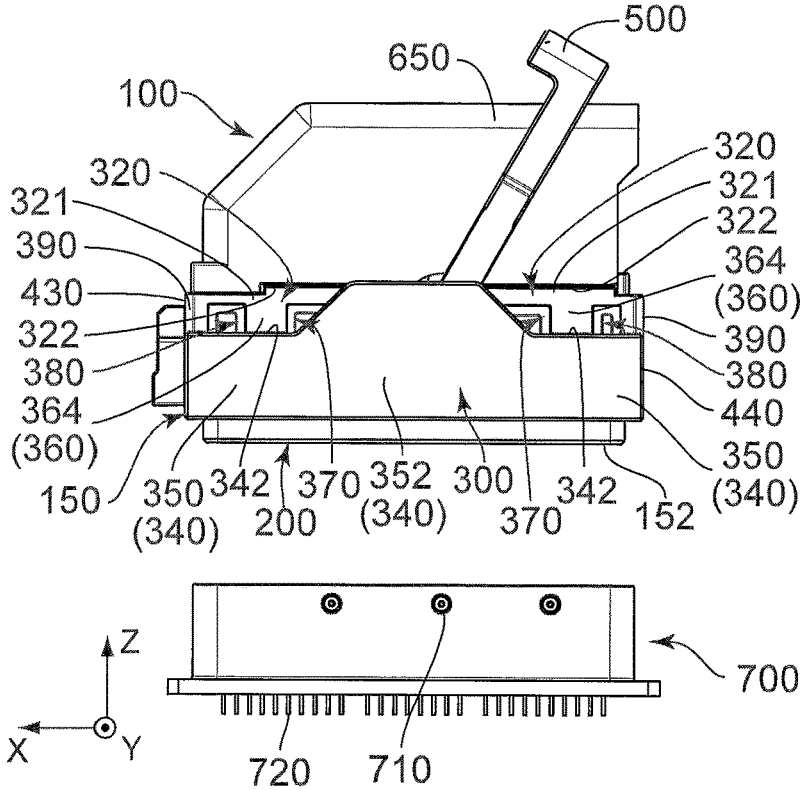
FIG. 2 is a side view showing the connector and the mating connector of FIG. 1.
Figure 3:
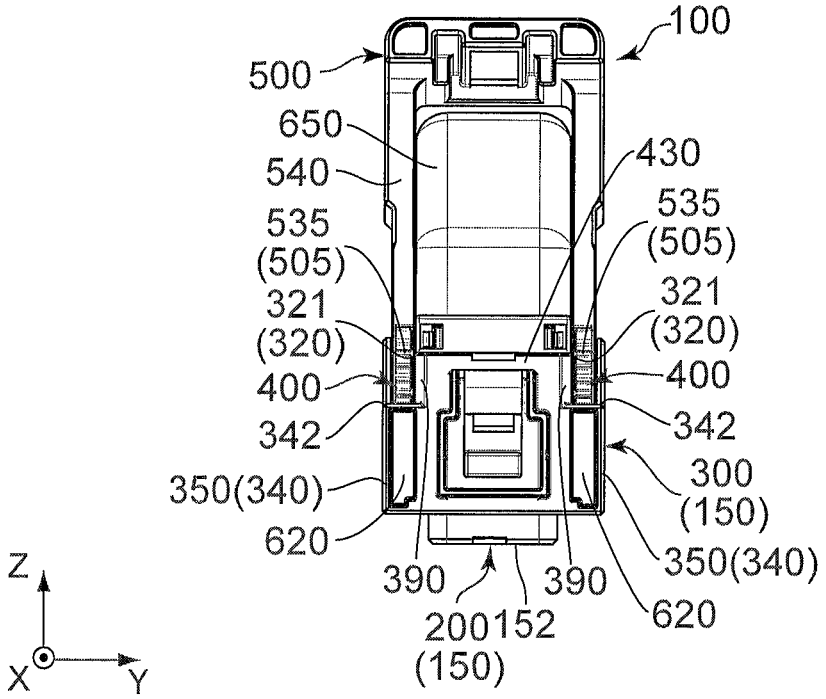
FIG. 3 is a front view showing the connector of FIG. 1.

As shown in FIGS. 1 to 3, a connector 100 according to an embodiment of the present invention comprises a housing 150, a plurality of terminals 600, a lever 500, two sliders 620 and a cover 650. The connector 100 of the present embodiment is mateable with and removable from a mating connector 700 along a first direction by operation of the lever 500. In the present embodiment, the first direction is an up-down direction. In the figure, the up-down direction is shown as a Z-direction. Specifically, it is assumed that upward is a positive Z-direction while downward is a negative Z-direction.

As shown in FIG. 1, the mating connector 700 of the present embodiment has six cam protrusions 710 and a plurality of mating terminals 720. Each of the cam protrusions 710 protrudes outward in a second direction. In the present embodiment, the second direction is a right-left direction. In the figure, the right-left direction is shown as a Y-direction. Specifically, it is assumed that rightward is a negative Y-direction while leftward is a positive Y-direction. More specifically, three of the cam protrusions 710 are provided on a left surface, or a positive Y-side surface, of the mating connector 700, while remaining three of the cam protrusions 710 are provided on a right surface, or a negative Y-side surface, of the mating connector 700.

As shown in FIGS. 10 to 16, the housing 150 of the present embodiment is made of insulator. The housing 150 comprises a first housing 200 and a second housing 300. The second housing 300 is attached to the first housing 200. The housing 150 has a mating end 152 which is configured to be mated with the mating connector 700.

Figure 22:
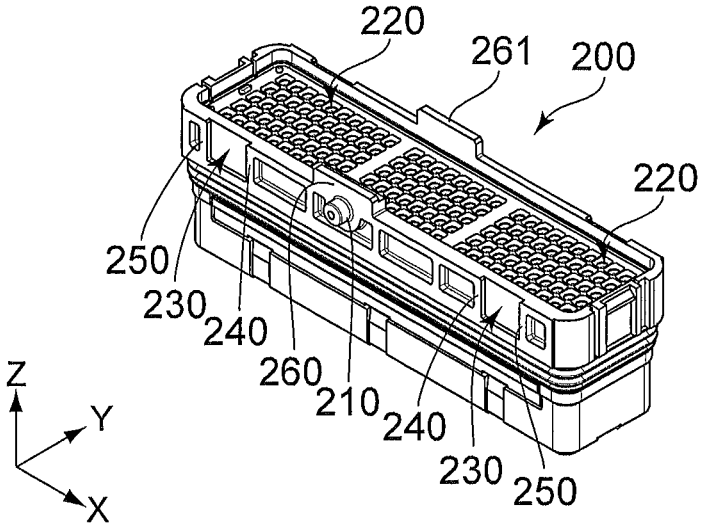
FIG. 22 is a perspective view showing a first housing included in the frame of FIG. 10.
Figure 23:
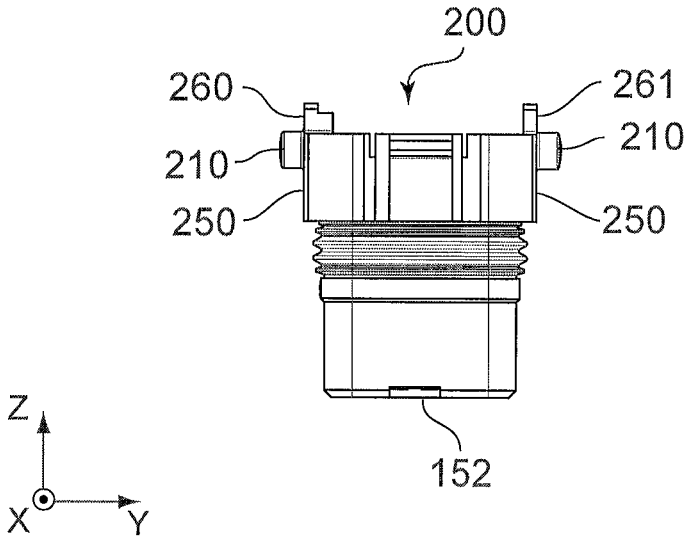
FIG. 23 is a front view showing the first housing of FIG. 22.

As shown in FIGS. 22 and 23, the first housing 200 of the present embodiment has a substantially cuboid shape extending in the up-down direction. More specifically, when the first housing 200 is viewed from its top, the first housing 200 has a rounded rectangular shape having two shorter sides and two longer sides. Each of the shorter sides of the rounded rectangular shape of the first housing 200 is parallel to the right-left direction. Each of the longer sides of the rounded rectangular shape of the first housing 200 is parallel to a third direction. In the present embodiment, the third direction is a front-rear direction. In the figures, the front-rear direction is shown as an X-direction. Specifically, it is assumed that forward is a positive X-direction while rearward is a negative X-direction. As understood from the FIGS. 22 and 23, a left surface, or a positive Y-side surface, of the first housing 200 includes one of the longer sides. Similarly, a right surface, or a negative Y-side surface, of the first housing 200 includes a remaining one of the longer sides. In addition, a front surface, or a positive X-side surface, of the first housing 200 includes one of the shorter sides. Similarly, a rear surface, or a negative X-side surface, of the first housing 200 includes a remaining one of the shorter sides.

As shown in FIGS. 22 and 23, the first housing 200 of the present embodiment has a bottom portion 152, two pivots 210, a plurality of terminal accommodating portions 220, four bridge portion accommodating portions 230, four first protrusions 240, four second protrusions 250 and projections 260, 261.

As shown in FIGS. 22 and 23, the bottom portion 152 of the present embodiment is positioned at a lower end of the first housing 200 in the up-down direction. The bottom portion 152 of the first housing 200 functions as the mating end 152 of the housing 150.

As shown in FIGS. 22 and 23, each of the pivots 210 of the present embodiment is positioned around a middle of the first housing 200 in the front-rear direction which is an upper part of the first housing 200. Each of the pivots 210 extends outward in the right-left direction, or in the second direction. More specifically, the pivot 210 at a left side of the first housing 200 extends leftward from the left surface of the first housing 200. Similarly, the pivot 210 at a right side of the first housing 200 extends rightward from the right surface of the first housing 200. Each of the pivots 210 has a central axis parallel to the right-left direction. The center axes of the two pivots 210 of the first housing 200 are coincident with each other. As described later, the pivots 210 support the lever 500 so that the lever 500 is rotatable.

As shown in FIGS. 22 and 23, each of the terminal accommodating portions 220 is a hole piercing the first housing 200 in the up-down direction.

As shown in FIGS. 22 and 23, each of the bridge portion accommodating portions 230 is recessed inward in the right-left direction. Each of the bridge portion accommodating portions 230 is opened upward and outward in the right-left direction. More specifically, each of the bridge portion accommodating portions 230 has two inner walls, a lower wall and an inner surface. The two inner walls face each other in the front-rear direction. The lower wall is perpendicular to the up-down direction. The inner surface is directed outward in the right-left direction. The bridge portion accommodating portions 230 are positioned in the vicinities of opposite ends, respectively, of each of the right surface and the left surface of the first housing 200 in the front-rear direction. Specifically, two of the bridge portion accommodating portions 230 are positioned in the vicinities of opposite ends, respectively, of an upper part of the left surface of the first housing 200 in the front-rear direction. Similarly, remaining two of the bridge portion accommodating portions 230 are positioned in the vicinities of opposite ends, respectively, of an upper part of the right surface of the first housing 200 in the front-rear direction.

As shown in FIGS. 22 and 23, when the first housing 200 is viewed from its outside in the right-left direction, each of the first protrusions 240 of the present embodiment has an outer circumference. The outer circumference of the first protrusion 240 consists of two shorter sides and two longer sides. Each of the shorter sides of the outer circumference of the first protrusion 240 is parallel to the first direction. Each of the longer sides of the outer circumference of the first protrusion 240 is parallel to the third direction. Each of the first protrusions 240 protrudes outward in the right-left direction. More specifically, the first protrusions 240 correspond to the bridge portion accommodating portions 230, respectively, and each of the first protrusions 240 is positioned inward of the bridge portion accommodating portion 230 corresponding thereto in the front-rear direction. The inner wall of each of the bridge portion accommodating portions 230, which is positioned inward thereof in the front-rear direction, is an outer end surface of the corresponding first protrusion 240 in the front-rear direction.

As shown in FIGS. 22 and 23, when the first housing 200 is viewed from its outside in the right-left direction, each of the second protrusions 250 of the present embodiment has an outer circumference. The outer circumference of the second protrusion 250 consists of two sides, each of which is parallel to the first direction, and two sides each of which is parallel to the third direction. Each of the second protrusions 250 protrudes outward in the right-left direction. More specifically, the second protrusions 250 correspond to the bridge portion accommodating portions 230, respectively, and each of the second protrusions 250 is positioned outward of the bridge portion accommodating portion 230 corresponding thereto in the front-rear direction. The inner wall of each of the bridge portion accommodating portions 230, which is positioned outward thereof in the front-rear direction, is an inner end surface of the corresponding second protrusion 250 in the front-rear direction.

As shown in FIGS. 22 and 23, the projections 260, 261 of the present embodiment correspond to the pivots 210, respectively, and each of the projections 260, 261 is positioned above the pivot 210 corresponding thereto in the up-down direction. Each of the projections 260, 261 forms an uppermost portion of the first housing 200. Each of the projections 260, 261 has an inner surface directed inward in the right-left direction.

As shown in FIGS. 17 to 21, the second housing 300 of the present embodiment has a top plate portion 310, two inner portions 320, two outer portions 340, four coupling portions 360, two first portions 370, four second portions 380, four connecting portions 390, four linking portions 395, side walls 430, 440, two lever accommodating portions 400 and two slider accommodating portions 420.

As shown in FIGS. 17 to 21, the top plate portion 310 of the present embodiment has a plate-like shape perpendicular to the up-down direction. More specifically, when the top plate portion 310 is viewed from its top, the top plate portion 310 has a rounded rectangular shape having two shorter sides and two longer sides. Each of the shorter sides of the rounded rectangular shape of the top plate portion 310 is parallel to the right-left direction. Each of the longer sides of the rounded rectangular shape of the top plate portion 310 is parallel to the front-rear direction. The top plate portion 310 is provided with a plurality of holes 312. Each of the holes 312 pierces the top plate portion 310 in the up-down direction. The holes 312 correspond to the terminal accommodating portions 220, respectively, of the first housing 200. The hole 312 and the corresponding terminal accommodating portion 220 are positioned at positions same as each other in an XY-plane. In other words, each of the holes 312 and the corresponding terminal accommodating portion 220 communicate with each other in the up-down direction.

As shown in FIGS. 17 to 21, the inner portions 320 are positioned at opposite ends, respectively, of the top plate portion 310 in the right-left direction. Each of the inner portions 320 has two inner side portions 321 and an inner main 323. Each of the inner side portions 321 extends in the front-rear direction. Each of the inner side portions 321 of the inner portion 320 at a left side of the second housing 300 protrudes outward in the right-left direction from a left end of the top plate portion 310. Each of the inner side portions 321 of the inner portion 320 at a right side of the second housing 300 protrudes outward in the right-left direction from a right end of the top plate portion 310. The inner main 323 has an outer surface directed outward in the right-left direction. The inner main 323 is positioned between the inner side portions 321 in the front-rear direction. The inner main 323 is positioned inward beyond any of the inner side portions 321 in the right-left direction. More specifically, in the right-left direction, the outer surface of the inner main 323 is positioned inward beyond an outer end of each of the inner side portions 321 in the right-left direction.

As shown in FIGS. 17 to 21, each of the inner portions 320 of the present embodiment is provided with two inner coupled portions 322. The two inner coupled portions 322 of the inner portion 320 are coupled with two of the coupling portions 360. More specifically, a part of a lower end of each of the inner side portions 321 of the inner portion 320 functions as the inner coupled portion 322.

As shown in FIGS. 10 to 16, the inner mains 323 of the inner portions 320 of the second housing 300 correspond to the projections 260, 261, respectively, of the first housing 200. Each of the inner mains 323 faces the projection 260, 261, corresponding thereto in the right-left direction. More specifically, the outer surface of each of the inner mains 323 is brought into contact with the inner surface of the projection 260, 261 corresponding thereto in the right-left direction.

As shown in FIGS. 17 to 21, the outer portions 340 are positioned at opposite ends, respectively, of the second housing 300 in the right-left direction. Each of the outer portions 340 of the present embodiment has a plate-like shape perpendicular to the right-left direction. Each of the outer portions 340 has a symmetrical shape with respect to a plane which is perpendicular to the front-rear direction while passing through a middle of the outer portion 340 in the front-rear direction. More specifically, each of the outer portions 340 has two outer side portions 350 and an outer main 352.

Figure 21:
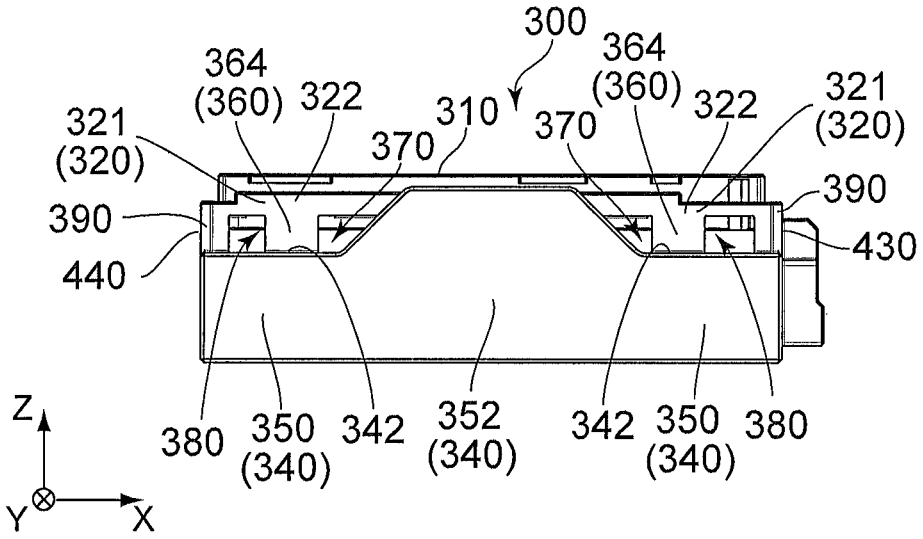
FIG. 21 is a side view showing the second housing of FIG. 17.

As shown in FIG. 21, each of the outer side portions 350 has a rectangular shape perpendicular to the right-left direction. The outer side portions 350 are positioned at opposite sides, respectively, of the outer portion 340 in the front-rear direction. In other words, the outer side portions 350 form outermost portions, respectively, of the outer portion 340 in the front-rear direction.

As shown in FIG. 21, the outer main 352 has a plate-like shape perpendicular to the right-left direction. An upper end of the outer main 352 is positioned above an upper end of each of the outer side portions 350 in the up-down direction. In addition, the upper end of the outer main 352 is positioned below an upper end of the top plate portion 310 in the up-down direction.

Figure 17:
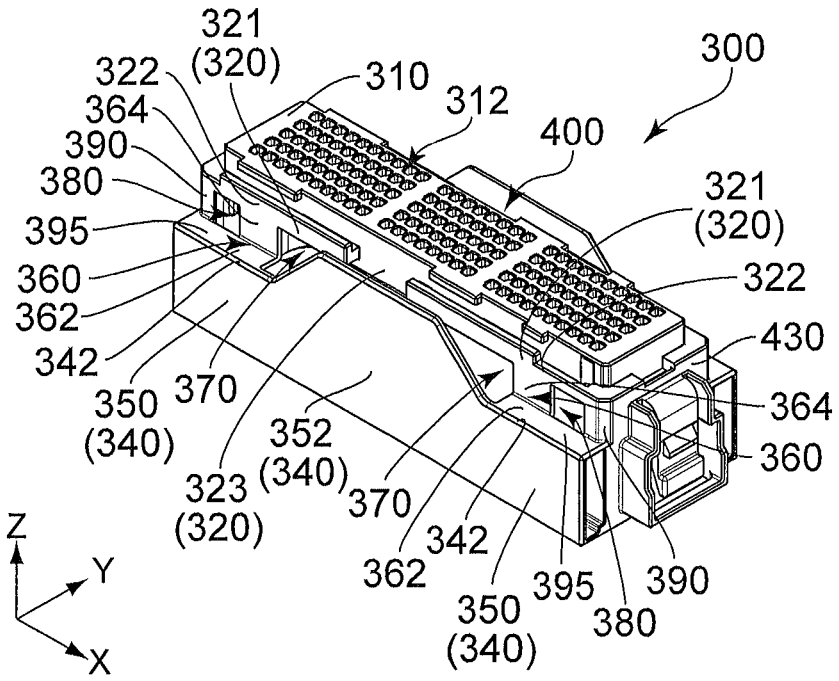
FIG. 17 is a perspective view showing a second housing included in the frame of FIG. 10.
Figure 19:
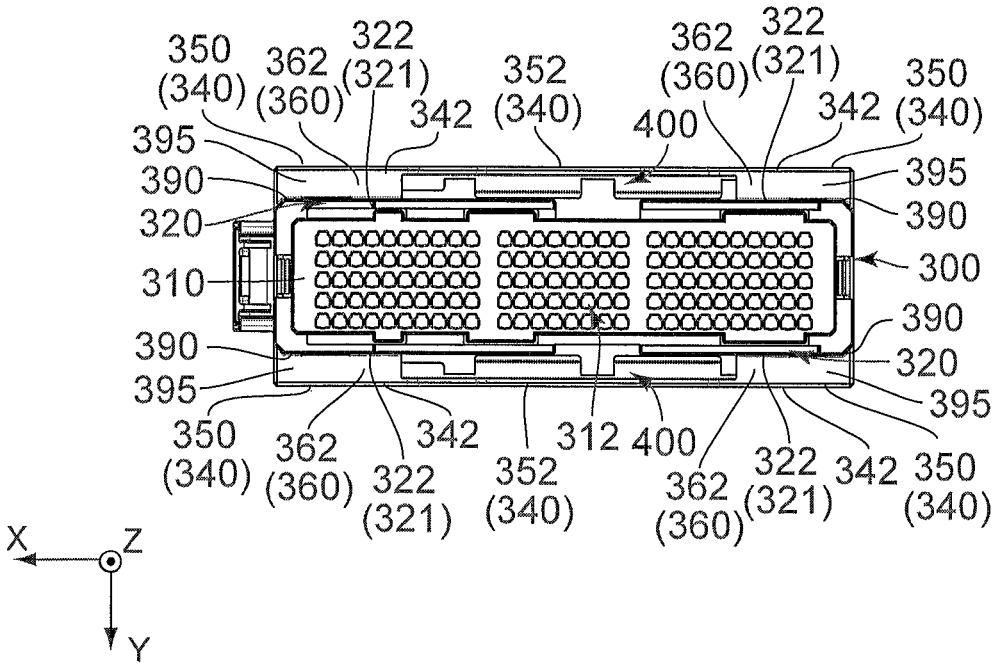
FIG. 19 is a top view showing the second housing of FIG. 17.

As shown in FIGS. 17, 19 and 21, the outer main 352 is sandwiched between the two outer side portions 350 in the front-rear direction. Specifically, a front end of the outer main 352 is connected with a rear end of the outer side portion 350 which is positioned at a front of the outer portion 340. In addition, a rear end of the outer main 352 is connected with a front end of the outer side portion 350 which is positioned at a rear of the outer portion 340.

Referring to FIGS. 17 to 21, in the right-left direction, or in the second direction, the outer portion 340 of the present embodiment is positioned away from the inner portion 320 while being positioned outward beyond the inner portion 320. More specifically, the outer portions 340 correspond to the inner portions 320, respectively, and, in the right-left direction, each of the outer portions 340 is positioned away from the corresponding inner portion 320 while being positioned outward beyond the corresponding inner portion 320. In the right-left direction, the outer main 352 of each of the outer portions 340 is positioned away from the inner main 323 of the corresponding inner portion 320 while being positioned outward beyond the inner main 323 of the corresponding inner portion 320. The outer side portions 350 of the outer portion 340 correspond to the inner side portions 321, respectively, of the corresponding inner portion 320. In the right-left direction, each of the outer side portions 350 is positioned away from the corresponding inner side portion 321 while being positioned outward beyond the corresponding inner side portion 321.

As understood from FIGS. 17 to 21, the upper end of the outer side portion 350 of each of the outer portions 340 is positioned below the corresponding inner portion 320 in the up-down direction. Specifically, the upper end of the outer side portion 350 is positioned below the lower end of the corresponding inner side portion 321 in the up-down direction. Accordingly, when the second housing 300 is viewed from its outside in the right-left direction, the inner side portion 321 is visible.

As understood from FIGS. 17 to 21, the upper end of the outer main 352 of each of the outer portions 340 is positioned above an upper end of the corresponding inner portion 320 in the up-down direction. Specifically, the upper end of the outer main 352 is positioned above an upper end of the corresponding inner main 323 in the up-down direction. In other words, when the second housing 300 is viewed from its outside in the right-left direction, the inner main 323 is invisible because the inner main 323 is hidden by the corresponding outer main 352. Furthermore, the upper end of the outer main 352 of each of the outer portions 340 is positioned above an upper end of each of the inner side portions 321 of the corresponding inner portion 320 in the up-down direction.

As shown in FIGS. 17 to 21, each of the outer portions 340 of the present embodiment is provided with two outer coupled portions 342. The outer coupled portions 342, the inner coupled portions 322 and the coupling portions 360 are provided on the second housing 300. The outer coupled portions 342 of the outer portion 340 are coupled with two of the coupling portions 360. More specifically, the outer coupled portions 342 are provided on the outer side portions 350, respectively, of the outer portion 340. The outer coupled portion 342 is a part of the upper end of the outer side portion 350. The outer coupled portion 342 and inner coupled portion 322 are positioned away from each other in a direction perpendicular to the second direction, or to the right-left direction. In the up-down direction, or in the first direction, the outer coupled portion 342 is positioned closer to the mating end 152 than the inner coupled portion 322 is. The outer coupled portion 342 is positioned below the inner coupled portion 322 in the up-down direction, or in the first direction.

Referring to FIGS. 10 to 16, the pivots 210 of the first housing 200 correspond to the outer portions 340, respectively, of the second housing 300. Each of the pivots 210 of the first housing 200 is positioned inward of the corresponding outer portion 340 of the second housing 300 in the right-left direction. Each of the pivots 210 of the first housing 200 and the outer main 352 of the corresponding outer portion 340 of the second housing 300 completely overlap with each other in an XZ-plane. In other words, when the housing 150 is viewed from its outside in the right-left direction, each of the pivots 210 of the first housing 200 is invisible because each of the pivots 210 is hidden by the outer main 352 of the corresponding outer portion 340 of the second housing 300.

As shown in FIGS. 17 to 21, the coupling portion 360 of the present embodiment has a substantially L-like cross-section in a plane perpendicular to the front-rear direction. The coupling portion 360 of the present embodiment has an extending portion 362 and a bridge portion 364. The bridge portion 364 is elastically deformable.

As shown in FIGS. 17 to 21, the extending portion 362 of the present embodiment has a plate-like shape perpendicular to the up-down direction. The extending portion 362 extends inward in the right-left direction, or in the second direction, from the outer coupled portion 342. The extending portion 362 has an inner end in the right-left direction.

As shown in FIGS. 17 to 21, the bridge portion 364 of the present embodiment has a plate-like shape intersecting with the right-left direction, or in the second direction. More specifically, the bridge portion 364 of the present embodiment has the plate-like shape perpendicular to the right-left direction and has an inner surface directed inward in the right-left direction. The bridge portion 364 extends downward in the up-down direction from the inner coupled portion 322. In the right-left direction, or in the second direction, the bridge portion 364 is positioned away from the outer portion 340 while being positioned inward beyond the outer portion 340. A lower end of the bridge portion 364 is connected with the inner end of the extending portion 362 in the right-left direction. The bridge portion 364 connects the extending portion 362 and the inner coupled portion 322 with each other.

As shown in FIGS. 17 to 21, the coupling portion 360 couples the outer coupled portion 342 of the outer portion 340 and the inner coupled portion 322 of the corresponding inner portion 320 with each other. The coupling portions 360 correspond to the outer side portions 350, respectively. The outer side portion 350 and the corresponding inner side portion 321 are coupled with each other by the corresponding coupling portion 360 through the outer coupled portion 342 and the inner coupled portion 322. The four coupling portions 360 of the present embodiment couple the four outer coupled portions 342 and the four inner coupled portions 322, respectively, with each other.

As shown in FIGS. 10 to 16, the bridge portions 364 of the coupling portions 360 of the second housing 300 correspond to the bridge portion accommodating portions 230, respectively, of the first housing 200. Each of the bridge portions 364 of the coupling portions 360 of the second housing 300 is positioned at a position same as a position of the corresponding bridge portion accommodating portion 230 of the first housing 200 in the right-left direction. In addition, each of the bridge portions 364 of the coupling portions 360 of the second housing 300 is positioned in the corresponding bridge portion accommodating portion 230 of the first housing 200 in the XZ-plane. Specifically, the bridge portions 364 of the coupling portions 360 of the second housing 300 are accommodated in the bridge portion accommodating portions 230, respectively, of the first housing 200. In the right-left direction, the inner surface of the bridge portion 364, which is directed inward in the right-left direction, faces the inner surface of the corresponding bridge portion accommodating portion 230 which is directed outward in the right-left direction. In the front-rear direction, an outer end surface of each of the bridge portions 364 in the front-rear direction faces the inner wall of the corresponding bridge portion accommodating portion 230 which is positioned outward thereof in the front-rear direction. In the front-rear direction, an inner end surface of each of the bridge portions 364 in the front-rear direction faces the inner wall of the corresponding bridge portion accommodating portion 230 which is positioned inward thereof in the front-rear direction. The lower end of each of the bridge portions 364 faces the lower wall of the corresponding bridge portion accommodating portion 230 in the up-down direction.

As shown in FIGS. 17 and 21, each of the first portions 370 of the present embodiment is a through hole. More specifically, each of the first portions 370 of the present embodiment is a hole which pierces the second housing 300 in the right-left direction.

As shown in FIGS. 17 to 21, the first portions 370 correspond to the outer portions 340 and the inner portions 320, respectively. In the right-left direction, or in the second direction, each of the first portions 370 is positioned away from the corresponding outer portion 340 while being positioned inward beyond the corresponding outer portion 340. Each of the first portions 370 is positioned at a position same as a position of the corresponding inner portion 320 in the right-left direction. The first portion 370 is positioned inward of the coupling portion 360 in the front-rear direction. Specifically, in the front-rear direction, the first portion 370 is positioned between the two coupling portions 360 which are connected with the corresponding inner portion 320. Each of the first portions 370 is positioned below the corresponding inner portion 320 in the up-down direction. Specifically, each of the first portions 370 is positioned below the inner side portions 321 of the corresponding inner portion 320 in the up-down direction. An outer edge of the first portion 370 in the front-rear direction is the inner end surface of the bridge portion 364 of the coupling portion 360 in the front-rear direction.

Figure 10:
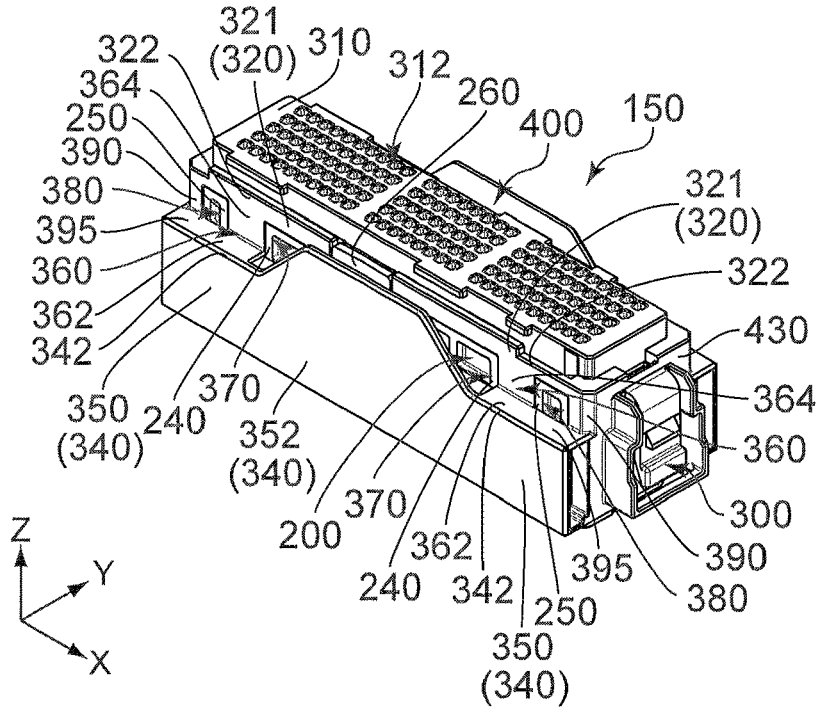
FIG. 10 is a perspective view showing a frame of the structure of FIG. 4 which excludes the lever.
Figure 11:
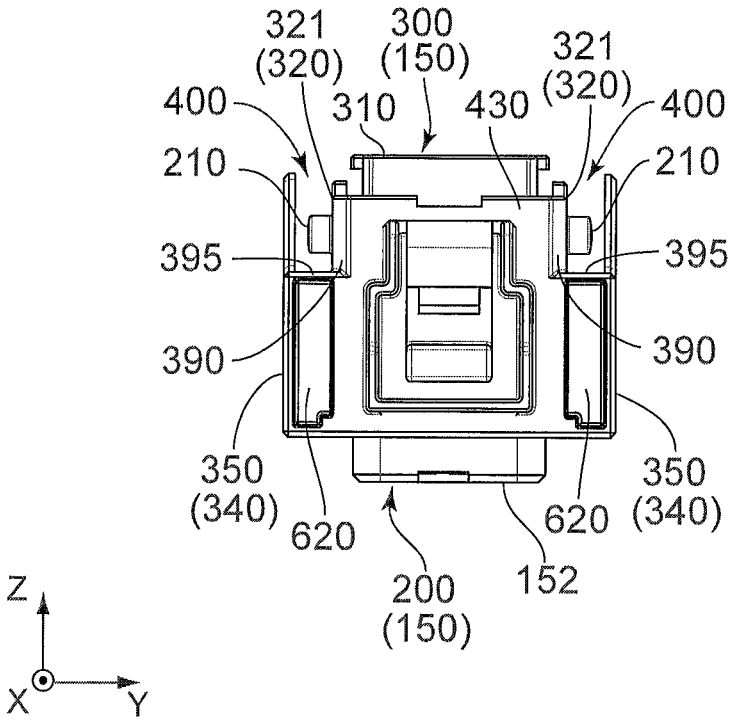
FIG. 11 is a front view showing the frame of FIG. 10.
Figure 12:
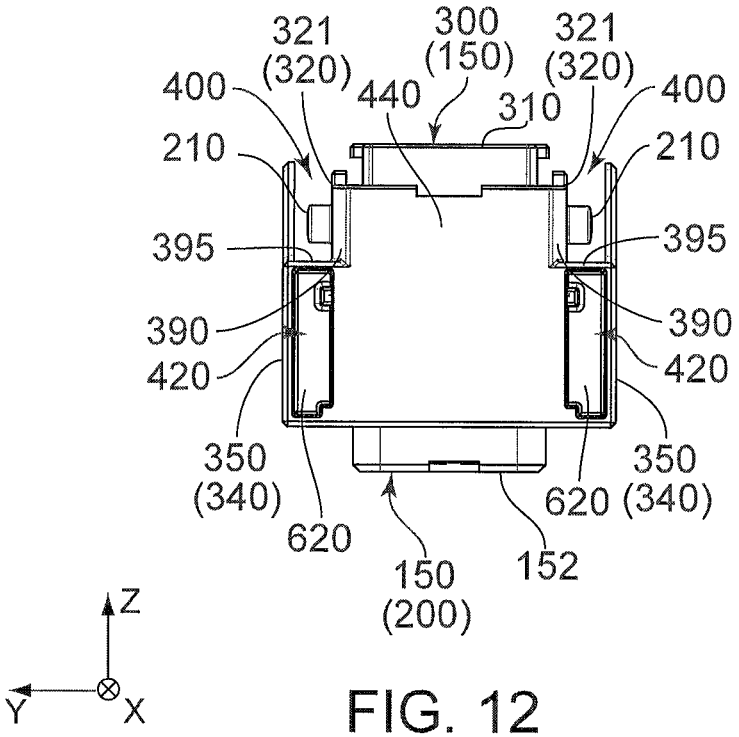
FIG. 12 is a rear view showing the frame of FIG. 10.
Figure 13:
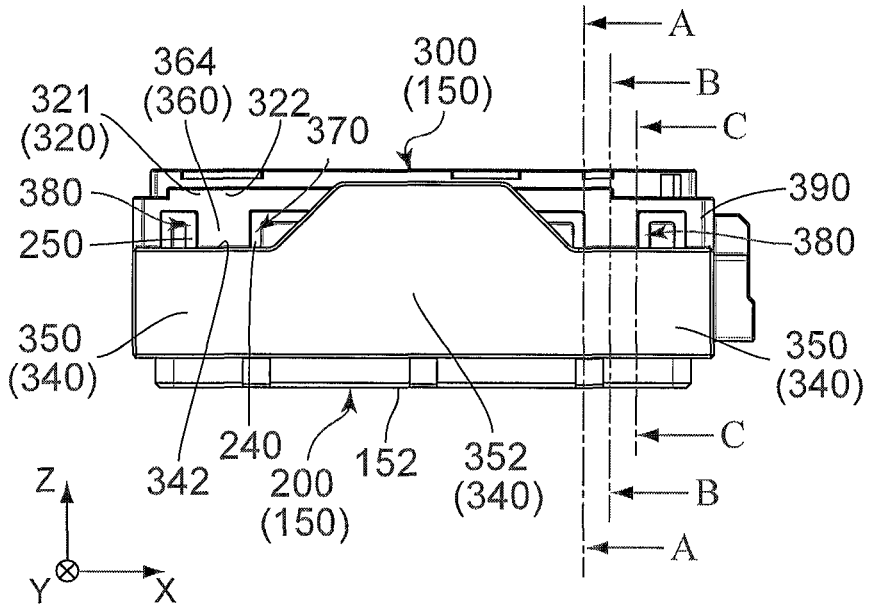
FIG. 13 is a side view showing the frame of FIG. 10.

Referring to FIGS. 10 and 13, in the right-left direction, the first portion 370 at the left side of the second housing 300 is positioned at a position same as a position of each of two of the first protrusions 240 which are positioned at the left side of the first housing 200. In addition, in the XZ-plane, each of the two first protrusions 240 at the left side of the first housing 200 is positioned in the first portion 370 which is positioned at the left side of the second housing 300. In other words, each of the two first protrusions 240 at the left side of the first housing 200 is accommodated in the first portion 370 which is positioned at the left side of the second housing 300.

Similarly, in the right-left direction, each of the remaining two first protrusions 240 at the right side of the first housing 200 is positioned at a position same as a position of the first portion 370 which is positioned at the right side of the second housing 300. In addition, in the XZ-plane, each of the remaining two first protrusions 240 at the right side of the first housing 200 is positioned in the first portion 370 which is positioned at the right side of the second housing 300. In other words, each of the remaining two first protrusions 240 at the right side of the first housing 200 is accommodated in the first portion 370 which is positioned at the right side of the second housing 300.

As shown in FIGS. 17 and 21, each of the second portions 380 is a through hole. More specifically, each of the second portions 380 is a hole which pierces the second housing 300 in the right-left direction. However, the present invention is not limited thereto. In the right-left direction, or in the second direction, the second portion 380 may be bottomed to have a thickness dimension smaller than a thickness dimension of the bridge portion 364.

As shown in FIGS. 17 and 21, in the right-left direction, or in the second direction, the second portion 380 of the present embodiment is positioned away from the outer portion 340 while being positioned inward beyond the outer portion 340.

Referring to FIGS. 17 to 21, the second portions 380 correspond to the inner side portions 321, the coupling portions 360 and the connecting portions 390, respectively. Each of the second portions 380 is positioned below the corresponding inner side portion 321 in the up-down direction. Specifically, an upper edge of each of the second portions 380 is a part of the lower end of the corresponding inner side portion 321. Each of the second portions 380 is positioned between the corresponding coupling portion 360 and the corresponding connecting portion 390 in the front-rear direction. Specifically, in the front-rear direction, each of the second portions 380 is positioned outward of the corresponding coupling portion 360 and inward of the corresponding connecting portion 390. An inner edge of each of the second portions 380 in the front-rear direction is the outer end surface of the bridge portion 364 of the corresponding coupling portion 360 in the front-rear direction. An outer edge of each of the second portions 380 in the front-rear direction is an inner end surface of the corresponding connecting portion 390 in the front-rear direction.

As shown in FIGS. 17 and 21, the first portion 370, the bridge portions 364 and the second portions 380, which are positioned at the left side of the second housing 300, are positioned at positions same as each other in the right-left direction. Similarly, the first portion 370, the bridge portions 364 and the second portions 380, which are positioned at the right side of the second housing 300, are positioned at positions same as each other in the right-left direction. The bridge portion 364 is sandwiched between the first portion 370 and the second portion 380 in a plane perpendicular to the right-left direction. In detail, the bridge portion 364 is sandwiched between the first portion 370 and the second portion 380 in the front-rear direction. Specifically, in the front-rear direction, each of the bridge portions 364 is positioned outward beyond the first portion 370 and inward beyond the second portion 380. Each of the second portions 380 is positioned between the bridge portion 364 of the corresponding coupling portion 360 and the corresponding connecting portion 390 in the front-rear direction. Specifically, in the front-rear direction, each of the second portions 380 is positioned outward beyond the bridge portion 364 of the corresponding coupling portion 360 and inward beyond the corresponding connecting portion 390.

As understood from FIGS. 10 to 16, in the front-rear direction, or in the third direction, the first portion 370 is positioned closer to the pivot 210 of the first housing 200 than each of the second portions 380 is. Specifically, in the front-rear direction, a distance between the first portion 370 and the pivot 210 is smaller than a distance between each of the second portions 380 and the pivot 210. The first portion 370 and each of the second portions 380 are positioned away from each other in the plane perpendicular to the right-left direction.

Referring to FIGS. 10 and 13, the second portions 380 of the second housing 300 correspond to the second protrusions 250, respectively, of the first housing 200. Each of the second portions 380 of the second housing 300 is positioned at a position same as a position of the corresponding second protrusion 250 of the first housing 200 in the right-left direction. Each of the second protrusions 250 of the first housing 200 is positioned in the corresponding second portion 380 of the second housing 300 in the XZ-plane. In other words, each of the second protrusions 250 of the first housing 200 is accommodated in the corresponding second portion 380 of the second housing 300.

As shown in FIGS. 17 and 21, the connecting portions 390 of the present embodiment correspond to the inner side portions 321 and the outer side portions 350, respectively. The four connecting portions 390 are divided into two groups. Specifically, one of the two groups includes two of the connecting portions 390 which are positioned at the left side of the second housing 300, and a remaining one of the two groups includes remaining two of the connecting portions 390 which are positioned at the right side of the second housing 300. The two connecting portions 390 at the left side of the second housing 300 are positioned at opposite ends, respectively, of the second housing 300 in the front-rear direction. The remaining two connecting portions 390 at the right side of the second housing 300 are positioned at the opposite ends, respectively, of the second housing 300 in the front-rear direction. Each of the connecting portions 390 is positioned between the corresponding inner side portion 321 and the corresponding outer side portion 350 in the up-down direction. Specifically, in the up-down direction, each of the connecting portions 390 is positioned below the corresponding inner side portion 321 and above the corresponding outer side portion 350. An upper end of each of the connecting portions 390 is connected with a lower end of the corresponding inner side portion 321 which is positioned at an outer end thereof in the front-rear direction.

As shown in FIGS. 17 to 21, each of the linking portions 395 of the present embodiment has a plate-like shape perpendicular to the up-down direction. The linking portions 395 connect the extending portions 362 and the connecting portions 390, respectively, with each other. Specifically, each of the linking portions 395 connects an outer end of the corresponding extending portion 362 in the front-rear direction and a lower end of the corresponding connecting portion 390 with each other. In addition, the linking portions 395 connect the connecting portions 390 and the outer side portions 350, respectively, with each other. Specifically, each of the linking portions 395 connects the lower end of the corresponding connecting portion 390 and the upper end of the corresponding outer side portion 350 with each other. The linking portion 395 and the corresponding extending portion 362 are positioned at positions same as each other in the up-down direction. The second portions 380 correspond to the linking portions 395, respectively. Each of the second portions 380 is positioned above the corresponding linking portion 395 in the up-down direction. Specifically, a lower edge of each of the second portions 380 is an upper end of the corresponding linking portion 395.

As shown in FIGS. 17 to 21, each of the side walls 430, 440 of the present embodiment extends in a YZ-plane. The side wall 430 is positioned at a front end of the second housing 300. The side wall 430 connects the connecting portion 390 at the left side of the second housing 300 and the connecting portion 390 at the right side of the second housing 300, which are positioned at a front thereof, with each other. The side wall 440 is positioned at a rear end of the second housing 300. The side wall 440 connects the connecting portion 390 at the left side of the second housing 300 and the connecting portion 390 at the right side of the second housing 300, which are positioned at a rear thereof, with each other.

As shown in FIGS. 17 to 20, the housing 150 has the lever accommodating portions 400 each of which is formed between the outer portion 340 and the inner portion 320 in the right-left direction, or in the second direction. The lever accommodating portions 400 partially accommodate the lever 500. Specifically, the lever accommodating portion 400 is formed between the outer portion 340 and the inner portion 320 corresponding thereto in the right-left direction. Each of the lever accommodating portions 400 of the present embodiment is a space extending in the front-rear direction. The lever accommodating portions 400 are positioned in the vicinities of the opposite ends, respectively, of the second housing 300 in the right-left direction. The lever accommodating portions 400 correspond to the outer portions 340 and the inner portions 320, respectively. Each of the lever accommodating portions 400 is positioned between the corresponding outer portion 340 and the corresponding inner portion 320 in the right-left direction. Specifically, in the right-left direction, each of the lever accommodating portions 400 is positioned inside the corresponding outer portion 340 and outside the corresponding inner portion 320. Each of the lever accommodating portions 400 is positioned between the coupling portions 360 in the front-rear direction, or in the third direction. Specifically, in the front-rear direction, each of the lever accommodating portions 400 is positioned between the two coupling portions 360 which are coupled with the corresponding outer portion 340.

Referring to 10 to 16, each of the lever accommodating portions 400 is provided between the first housing 200 and the second housing 300 in the right-left direction, or in the second direction. The lever accommodating portions 400 are positioned in the vicinities of opposite ends, respectively, of the housing 150 in the right-left direction. In the right-left direction, one of the lever accommodating portions 400 is provided between the left surface of the first housing 200 and the outer main 352 of the outer portion 340 which is positioned at the left side of the second housing 300. In the right-left direction, a remaining one of the lever accommodating portions 400 is provided between the right surface of the first housing 200 and the outer main 352 of the outer portion 340 which is positioned at the right side of the second housing 300. The two pivots 210 of the first housing 200 of the housing 150 are positioned in the lever accommodating portions 400, respectively.

Figure 18:
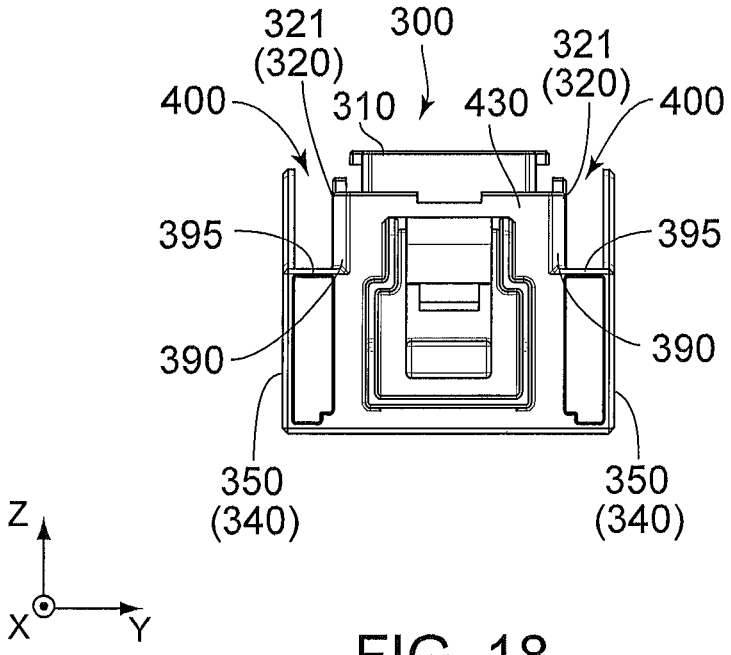
FIG. 18 is a front view showing the second housing of FIG. 17.
Figure 20:
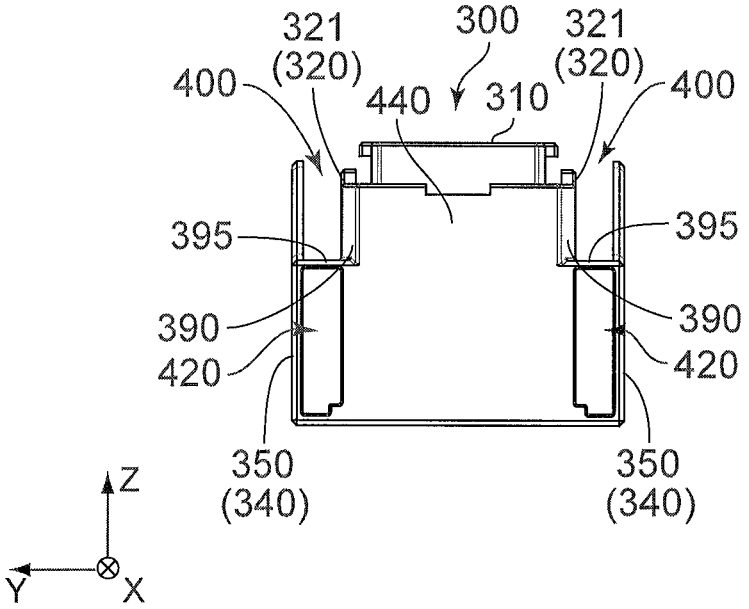
FIG. 20 is a rear view showing the second housing of FIG. 17.

As shown in FIGS. 17, 18 and 20, each of the slider accommodating portions 420 of the present embodiment is a space extending in the front-rear direction. The slider accommodating portions 420 are positioned between the outer portions 340 and the inner portions 320, respectively, in the right-left direction. Specifically, in the right-left direction, each of the slider accommodating portions 420 is positioned inside the corresponding outer portion 340 and outside the corresponding inner portion 320. In addition, the slider accommodating portions 420 are positioned below the lever accommodating portions 400, respectively, in the up-down direction.

Figure 14:
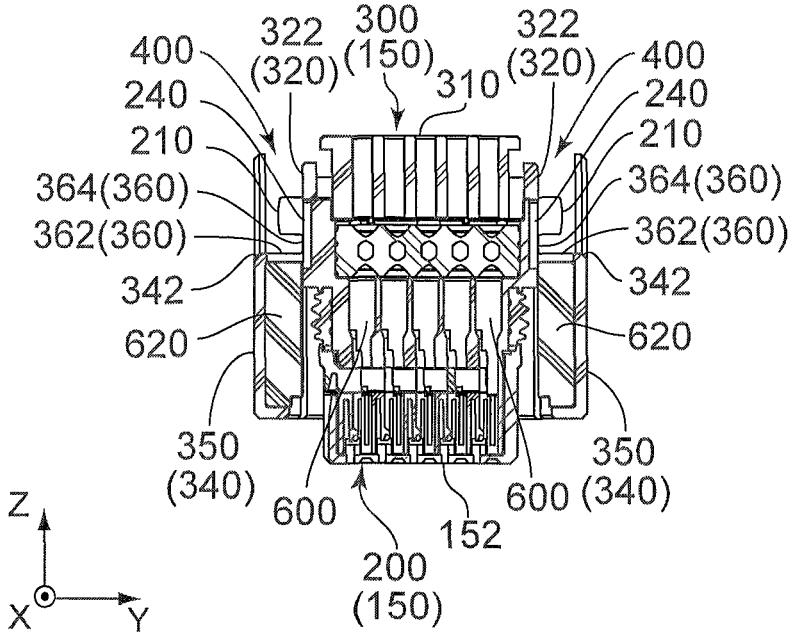
FIG. 14 is a cross-sectional view showing the frame of FIG. 13, taken along line A-A.
Figure 15:
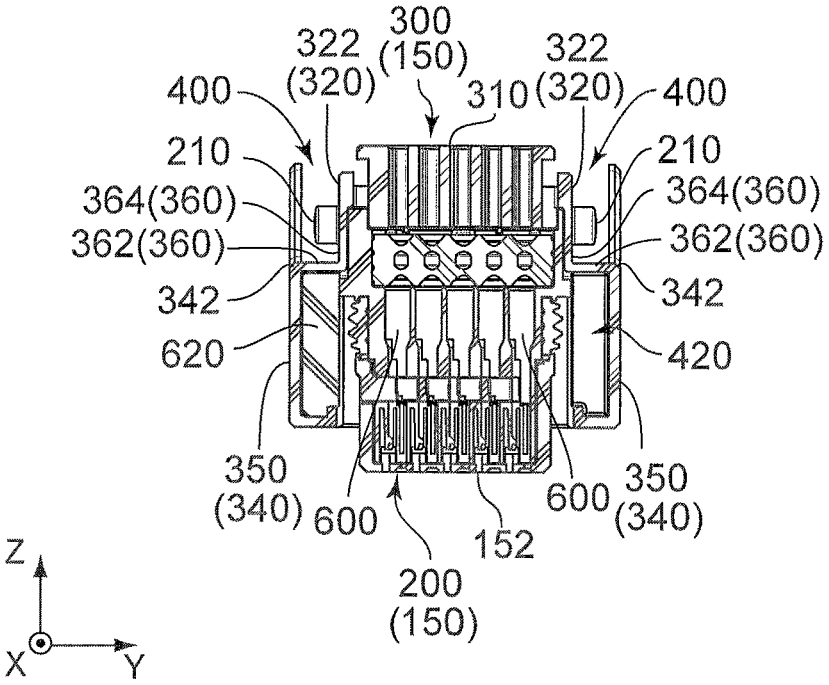
FIG. 15 is a cross-sectional view showing the frame of FIG. 13, taken along line B-B.
Figure 16:
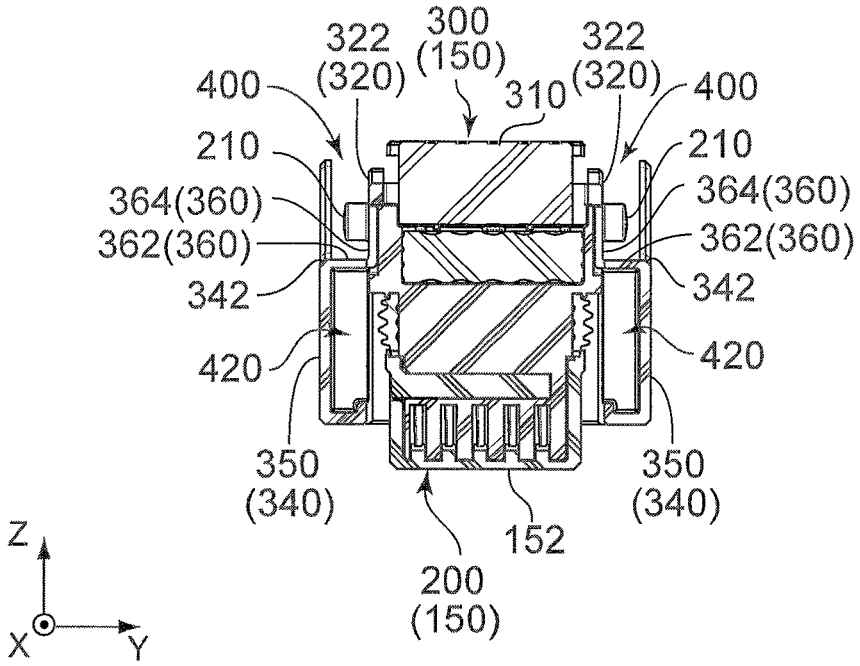
FIG. 16 is a cross-sectional view showing the frame of FIG. 13, taken along line C-C.

Referring to FIGS. 14 and 22, each of the terminals 600 of the present embodiment is made of conductor. The terminals 600 are accommodated and held in the terminal accommodating portions 220, respectively, of the first housing 200 of the housing 150. In other words, the first housing 200 of the present embodiment holds the plurality of terminals 600. The terminals 600 of the present embodiment are configured to be connected with the mating terminals 720, respectively, of the mating connector 700 when the connector 100 and the mating connector 700 are mated with each other.

As shown in FIGS. 1 to 4, the lever 500 of the present embodiment is attached to the housing 150. A specific method of attaching the lever 500 to the housing 150 will be described later.

Figure 24:
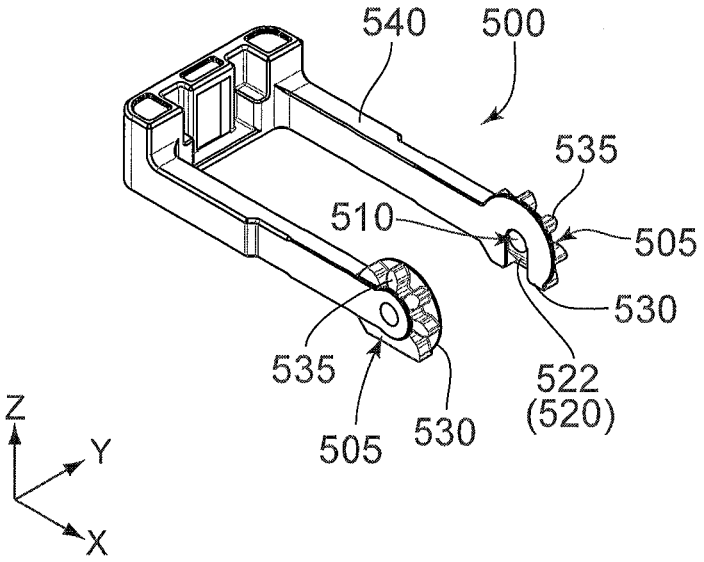
FIG. 24 is a perspective view showing the lever included in the structure of FIG. 4.
Figure 25:
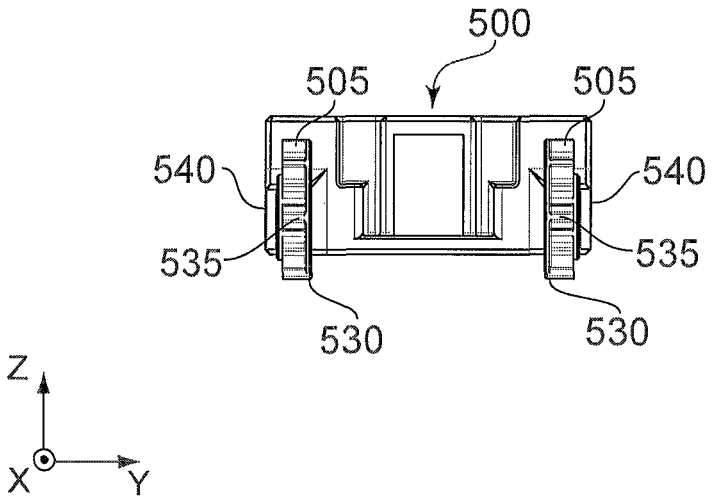
FIG. 25 is a front view showing the lever of FIG. 24.
Figure 26:
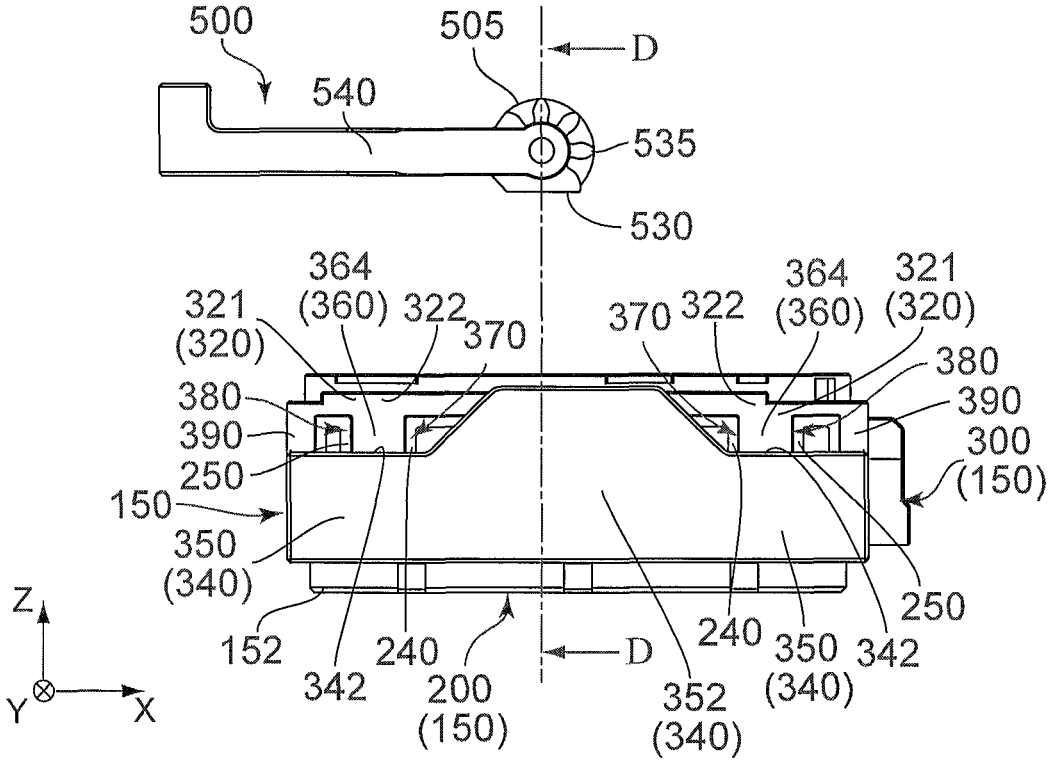
FIG. 26 is a side view for use in explaining how to attach the lever to the frame of FIG. 10, wherein the lever is not attached to the frame.
Figure 27:
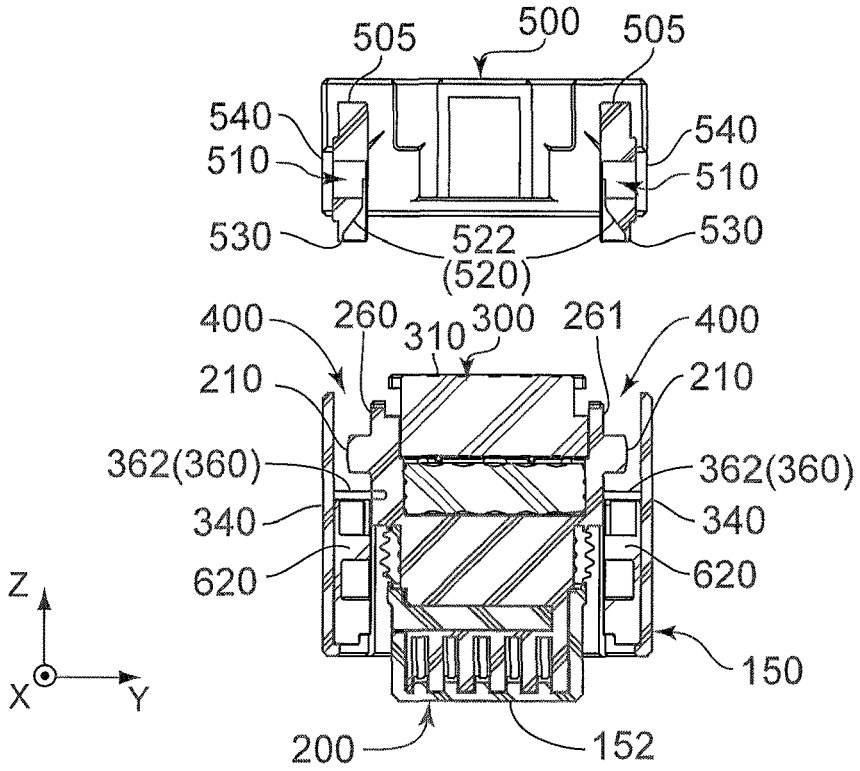
FIG. 27 is a cross-sectional view showing a structure of FIG. 26, taken along line D-D.
Figure 28:
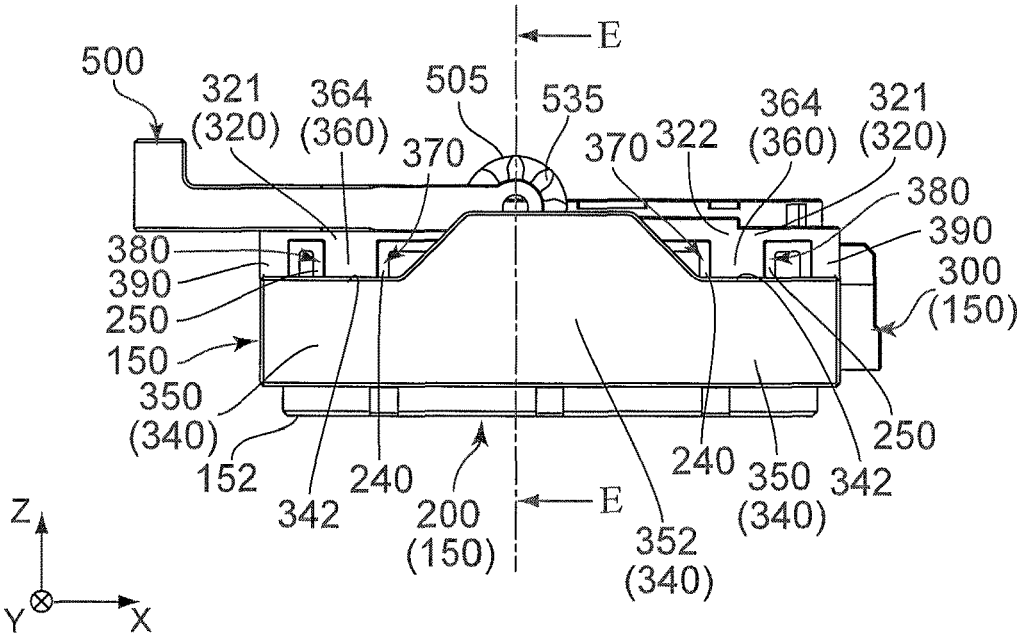
FIG. 28 is another side view for use in explaining how to attach the lever to the frame of FIG. 10, wherein pivots of the first housing of a housing of the frame are brought into contact with guide surfaces of pivot guide portions of pinion portions, respectively, of the lever in a Z-direction.

As shown in FIGS. 24 and 25, the lever 500 of the present embodiment has an arm 540 and two pinion portions 505. In the lever 500 shown in FIG. 24, the arm 540 has a substantially U-shape when viewed along the up-down direction, and the pinion portions 505 are provided on front ends, respectively, of the arm 540.

As shown in FIGS. 24 and 25, each of the pinion portions 505 of the present embodiment has an outer circumference portion 530, a bearing (bearing hole, pivot receiving portion) 510, a pivot guide portion 520 and teeth 535.

As shown in FIGS. 24 and 25, the outer circumference portion 530 of the present embodiment defines an outer circumference of the pinion portion 505 in a direction perpendicular to the right-left direction.

As shown in FIGS. 24 and 25, the bearing 510 of the present embodiment is recessed in the right-left direction, or in the second direction. More specifically, the bearing 510 of the present embodiment has a center axis parallel to the right-left direction and is recessed outward in the right-left direction. The center axes of the two bearings 510 of the pinion portions 505 are coincident with each other. The bearing 510 is positioned away from the outer circumference portion 530 in the direction perpendicular to the right-left direction, or to the second direction. The bearing 510 receives the pivot 210 of the first housing 200 of the housing 150. More specifically, the bearings 510 of the pinion portions 505 of the lever 500 correspond to the pivots 210, respectively, of the first housing 200 of the housing 150, and each of the bearings 510 receives the corresponding pivot 210.

As shown in FIGS. 24 and 25, the pivot guide portion 520 of the present embodiment is a groove which extends from the outer circumference portion 530 of the lever 500 to the bearing 510 of the lever 500 in the direction perpendicular to the right-left direction, or to the second direction. The pivot guide portion 520 has a guide surface 522 which intersects with the plane perpendicular to the right-left direction, or a plane perpendicular to the second direction. More specifically, the guide surface 522 of the pivot guide portion 520 illustrated in FIG. 24 is sloped upward and inward in the right-left direction.

Referring to FIGS. 4, 6 and 14 to 16, each of the sliders 620 of the present embodiment has a plate-like shape which extends in the front-rear direction and which is perpendicular to the right-left direction. Each of the sliders 620 has a rack 621 and three cam ditches (not shown). The sliders 620 are accommodated in the slider accommodating portions 420, respectively, of the second housing 300. The sliders 620 correspond to the pinion portions 505, respectively, of the lever 500. The rack 621 of each of the sliders 620 is meshed with the teeth 535 of the corresponding pinion portion 505 of the lever 500 to convert a rotational movement of the lever 500 into a movement of each of the sliders 620 in the front-rear direction. The cam ditches of the slider 620 are configured to receive three of the cam protrusions 710 of the mating connector 700 when the connector 100 and the mating connector 700 are mated with each other.

As shown in FIGS. 1 to 3, the cover 650 of the present embodiment has an opening 652 at its rear end. The cover 650 is positioned upward of the housing 150 in the up-down direction. The cover 650 is attached to the housing 150.

A method of attaching the lever 500 to the housing 150 is described below.

Referring to FIGS. 24 to 29, first, the lever 500 is positioned relative to the housing 150 so that each of the bearings 510 of the pinion portions 505 of the lever 500 and the corresponding pivot 210 of the first housing 200 of the housing 150 are arranged on a single axis parallel to the up-down direction. Meanwhile, the lever 500 and the housing 150 are in a state shown in each of FIGS. 26 and 27. After that, when the lever 500 is moved downward relative to the housing 150, the lever 500 and the housing 1500 are in a state shown in each of FIGS. 28 and 29.

Figure 29:
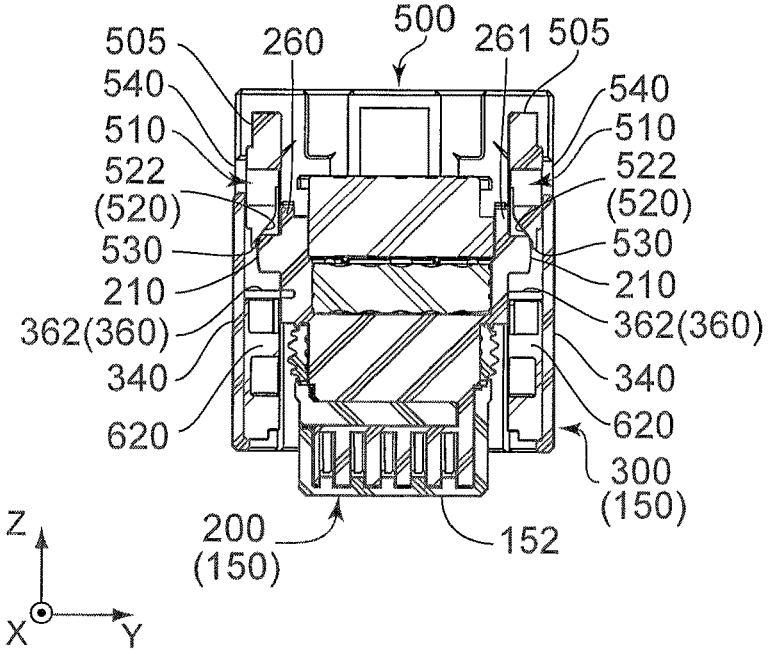
FIG. 29 is a cross-sectional view showing a structure of FIG. 28, taken along line E-E.

Meanwhile, as shown in FIG. 29, the guide surface 522 of the pivot guide portion 520 of each of the pinion portions 505 of the lever 500 is brought into contact with the corresponding pivot 210 of the first housing 200 of the housing 150 in the up-down direction.

When the lever 500 is further moved downward under this state, each of the pinion portions 505 of the lever 500 is pushed outward in the right-left direction by the corresponding pivot 210. Meanwhile, the arm 540 of the lever 500 is deformed so as to have an increased distance between the front ends of the arm 540 in the right-left direction. Also meanwhile, the outer main 352 of each of the outer portions 340 of the second housing 300 of the housing 150 is deformed outward in the right-left direction. As the outer main 352 of each of the outer portions 340 is deformed outward in the right-left direction, an inner end of each of the outer side portions 350 in the front-rear direction is moved outward in the right-left direction, so that the lower end of each of the bridge portions 364 is moved outward in the right-left direction.

As described above, the bridge portion 364 of the coupling portion 360 of the second housing 300 is sandwiched between the first portion 370 and the second portion 380 in the plane perpendicular to the right-left direction, or to the second direction. Accordingly, the bridge portion 364 of the present embodiment is more elastically deformable outward in the right-left direction in comparison with an assumption where the bridge portion 364 be rigidly coupled with the second housing 300 in the plane perpendicular to the right-left direction. Thus, the lever 500 is easily inserted into the housing 150. Especially, in a case where the second portion 380 is the through hole, the bridge portion 364 is still more elastically deformable outward in the right-left direction in comparison with an assumption where a thickness dimension of the second portion 380 be smaller than the thickness dimension of the bridge portion 364 in the right-left direction. Thus, the lever 500 is still easily inserted into the housing 150.

Figure 4:
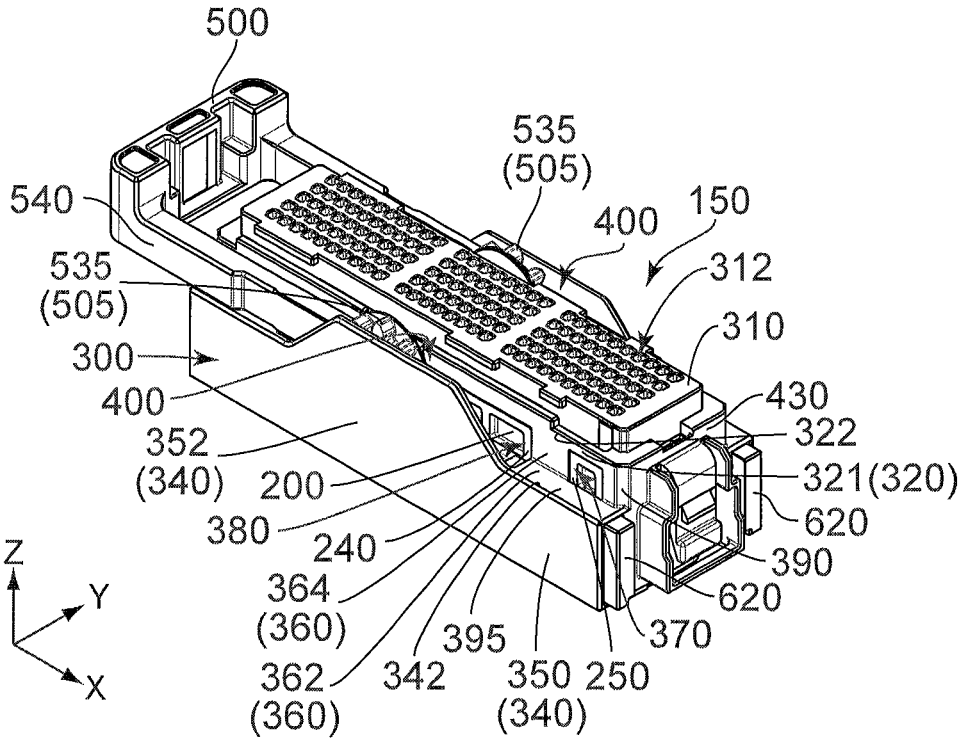
FIG. 4 is a perspective view showing a structure of the connector of FIG. 1 which excludes a cover. In the figure, the lever is positioned at a second position.
Figure 5:
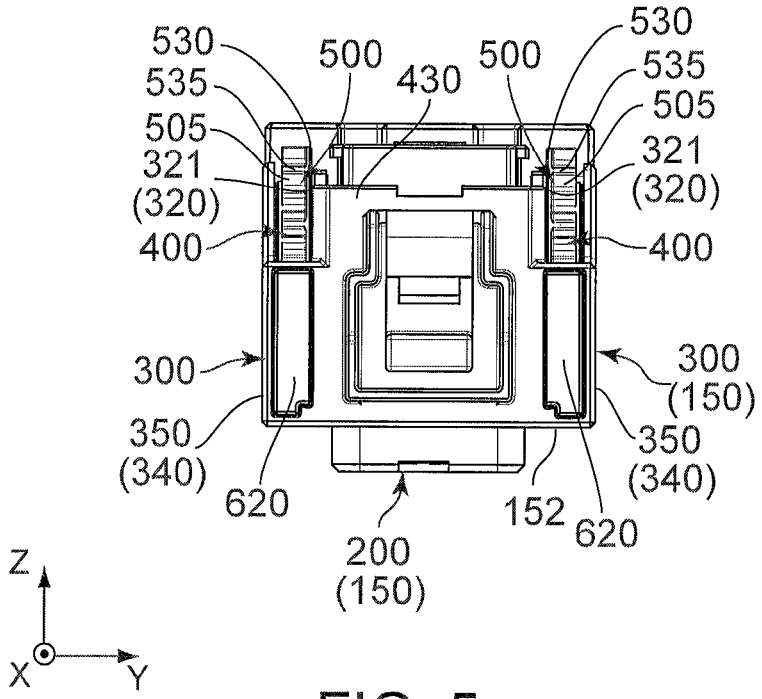
FIG. 5 is a front view showing the structure of FIG. 4.
Figure 6:
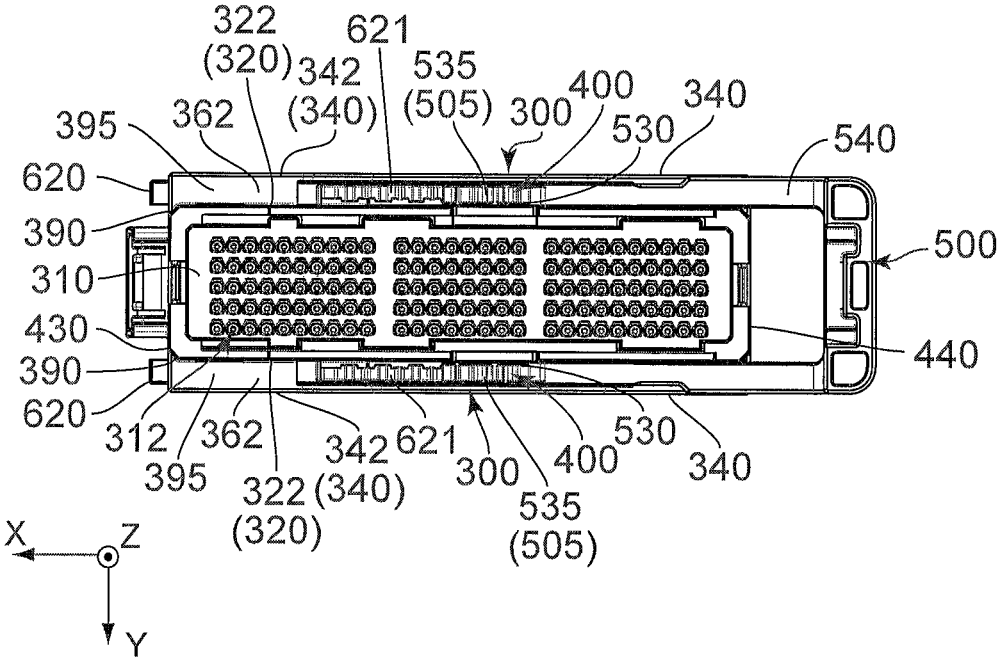
FIG. 6 is a top view showing the structure of FIG. 4.
Figure 7:
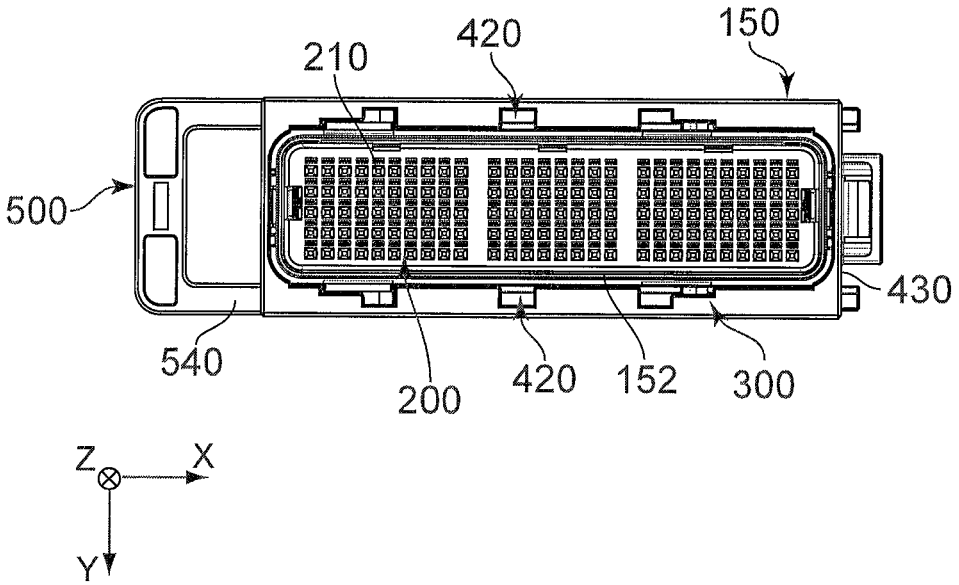
FIG. 7 is a bottom view showing the structure of FIG. 4.
Figure 8:
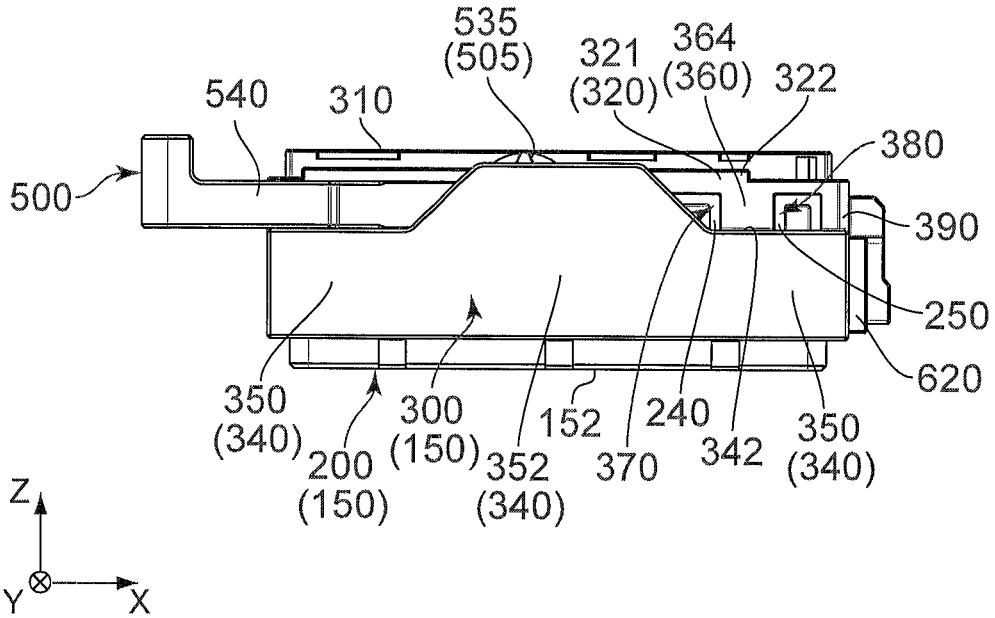
FIG. 8 is a side view showing the structure of FIG. 4.
Figure 9:
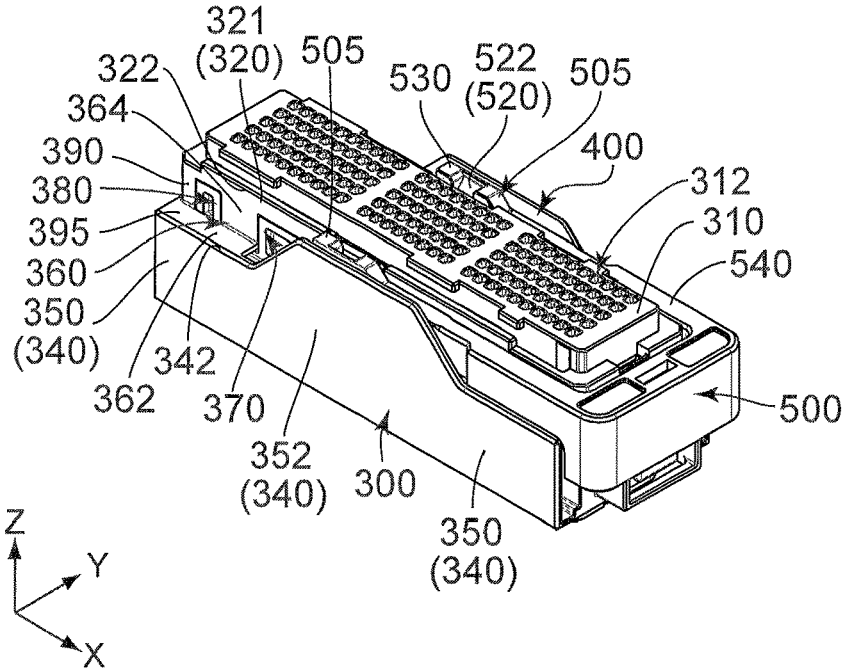
FIG. 9 is another perspective view showing the structure of FIG. 4, wherein the lever is positioned at a third position.

After that, when the lever 500 is still further moved downward so that a lower end of the bearing 510 of each of the pinion portions 505 of the lever 500 is positioned at a position same as a position of a lower end of the corresponding pivot 210 in the up-down direction, the bearing 510 of each of the pinion portions 505 of the lever 500 accommodates the corresponding pivot 210. Meanwhile, the arm 540 of the lever 500 restores its original shape while the outer mains 352 of the outer portions 340 of the second housing 300 of the housing 150 restore their original shapes. Specifically, the lever 500 and the housing 150 are relatively positioned as shown in FIG. 4.

As described above, the guide surface 522 of each of the pivot guide portions 520 of the lever 500 is sloped inward in the right-left direction. Specifically, in the right-left direction, a travel distance, by which each of the pinion portions 505 of the lever 500 is required to be moved when the lever 500 is tried to be removed from the housing 150 after the attachment of the lever 500 to the housing 150, is greater than a travel distance by which each of the pinion portions 505 of the lever 500 is required to be moved when the lever 500 begins to be inserted into the housing 150. Accordingly, in the connector 100 of the present embodiment, the lever 500 is hardly removed from the housing 150 after the lever 500 is attached to the housing 150.

Referring to FIGS. 1, 4, 9 and 29, since the lever 500 is attached to the housing 150 as described above, the pivots 210 support the lever 500 so that the lever 500 is rotatable. More specifically, the lever 500 is rotatable from a second position to a third portion through a first position. Similarly, the lever 500 is rotatable from the third position to the second position through the first position.

The structure of the housing 150 is not limited thereto. For example, the housing 150 can be modified as described below.

Figure 30:
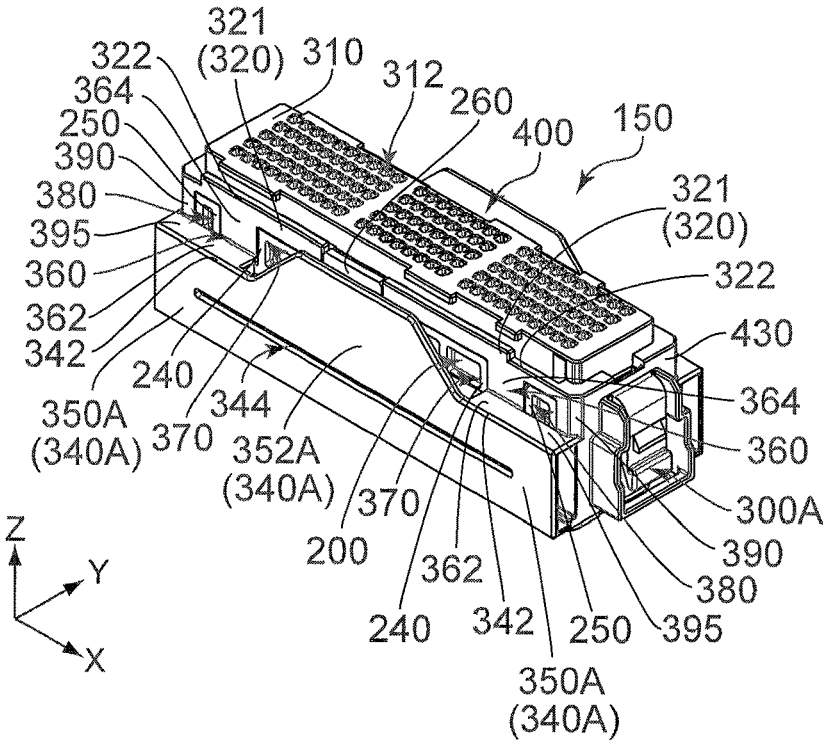
FIG. 30 is a perspective view showing a modification of the frame of FIG. 10.
Figure 31:
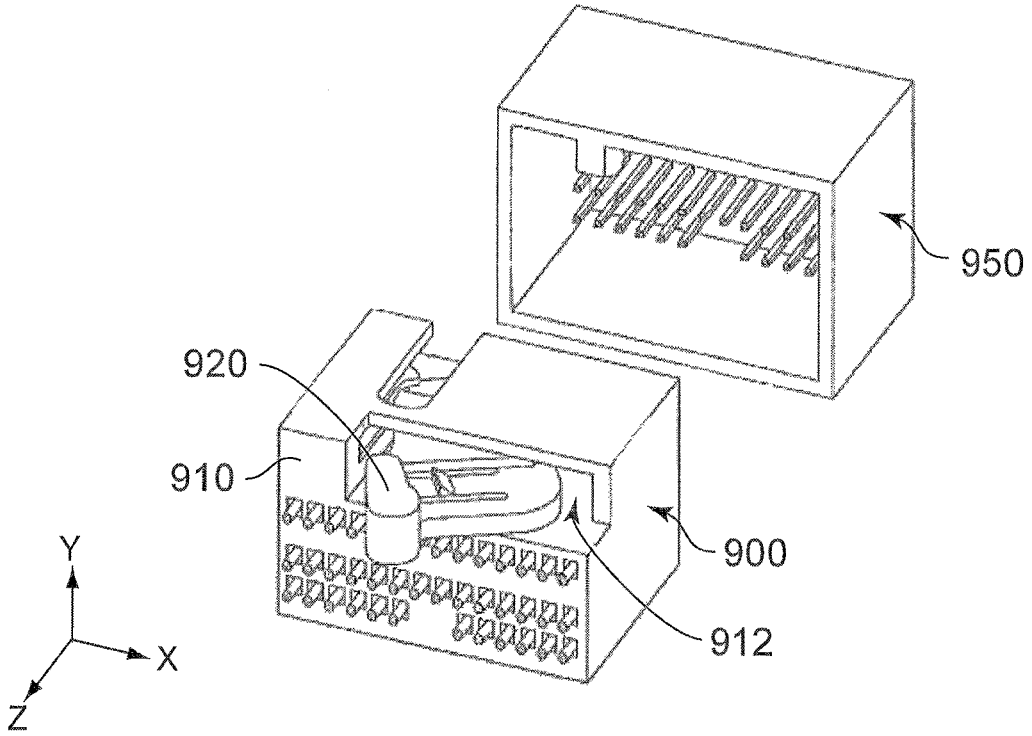
FIG. 31 PRIOR ART
FIG. 31 is a perspective view showing a connector and a mating connector of Patent Document 1, wherein the connector and the mating connector are not mated with each other.
Figure 32:
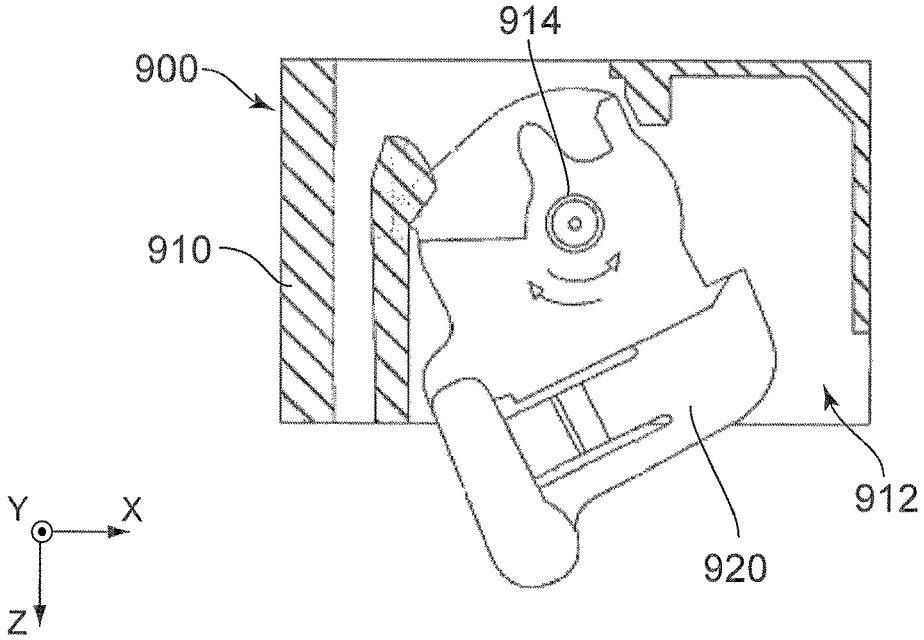
FIG. 32 PRIOR ART
FIG. 32 is a cross-sectional view showing the connector of FIG. 31.

Referring to FIG. 30, a housing 150A according to a modification of the present invention is made of insulator. Specifically, the housing 150A of the present embodiment has a first housing 200 and a second housing 300A. The first housing 200 of the present modification is similar to the first housing 200 of the aforementioned embodiment. Accordingly, detail explanation thereabout is omitted.

Referring to FIG. 30, the second housing 300A of the present modification has a top plate portion 310, two inner portions 320, two outer portions 340A, four coupling portions 360, two first portions 370, four second portions 380, four connecting portions 390, four linking portions 395, side walls 430, 440, two lever accommodating portions 400 and two slider accommodating portions 420. The components of the second housing 300A except for the outer portions 340A are similar to the components of the second housing 300 of the aforementioned embodiment. Accordingly, detail explanation thereabout is omitted.

As shown in FIG. 30, each of the outer portions 340A of the present modification has two outer side portions 350A and an outer main 352A. In addition, each of the outer portions 340A of the present modification is provided with a ditch 344. Except that the outer portion 340A of the present modification is provided with the ditch 344, the outer portion 340A of the present modification has a structure similar to that of the outer portion 340 of the aforementioned embodiment. Accordingly, detail explanation about components of the outer portion 340A other than the ditch 344 is omitted.

As shown in FIG. 30, the ditch 344 of the present modification extends so as to intersect with the up-down direction, or the first direction. More specifically, the ditch 344 extends in the front-rear direction and traverses the outer main 352A to reach each of the outer side portions 350A. The ditch 344 pierces the outer portion 340A in the right-left direction, or in the second direction. Referring to FIGS. 2, 23 and 30, the ditch 344 is positioned between a mating end 152 and a pivot 210 in the up-down direction, or in the first direction. More specifically, the ditch 344 is positioned between an upper end and a lower end of each of the outer side portions 350A in the up-down direction.

Referring to FIG. 30, when a lever 500 is attached to the housing 150A in an assembly process of a connector (not shown) into which the housing 150A of the present modification is assembled, an upper part of the outer portion 340A which is above the ditch 344 can be more deformed outward in the right-left direction than that of the housing 150 of the aforementioned embodiment. Accordingly, it is easily to attach the lever 500 to the housing 150A.

Although the specific explanation about the present invention is made above referring to the embodiments, the present invention is not limited thereto and is susceptible to various modifications and alternative forms.

Although the outer portion 340, 340A of the present embodiments has the four outer coupled portions 342, the present invention is not limited thereto. Specifically, it is sufficient that the outer portion 340, 340A is provided with at least one outer coupled portion 342.

Although the inner portion 320 of the present embodiment has the four inner coupled portions 322, the present invention is not limited thereto. Specifically, it is sufficient that the inner portion 320 is provided with at least one inner coupled portion 322.

Although the housing 150, 150A of the connector 100 of the present embodiments has the four coupling portions 360, the present invention is not limited thereto. Specifically, it is sufficient that the housing 150, 150A has at least one coupling portion 360 which couples the at least one outer coupled portion 342 and the at least one inner coupled portion 322 with each other.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising a housing and a lever, wherein:

the connector is mateable with and removable from a mating connector along a first direction by operation of the lever;

the housing has an inner portion, an outer portion, at least one coupling portion, a pivot, a first portion and a second portion;

the outer portion is provided with at least one outer coupled portion;

in a second direction perpendicular to the first direction, the outer portion is positioned away from the inner portion while being positioned outward beyond the inner portion;

the housing has a lever accommodating portion between the outer portion and the inner portion in the second direction;

the lever accommodating portion partially accommodates the lever;

the pivot is positioned inside the lever accommodating portion;

the pivot supports the lever so that the lever is rotatable;

the inner portion is provided with at least one inner coupled portion;

in the second direction, each of the first portion and the second portion is positioned away from the outer portion while being positioned inward beyond the outer portion;

the at least one coupling portion couples the at least one outer coupled portion and the at least one inner coupled portion with each other;

the at least one coupling portion has a bridge portion which is elastically deformable;

in the second direction, the bridge portion is positioned away from the outer portion while being positioned inward beyond the outer portion;

the bridge portion is sandwiched between the first portion and the second portion in a plane perpendicular to the second direction;

the housing comprises a first housing and a second housing; and the first portion is a hole which pierces the second housing in the second direction.

2. The connector as recited in claim 1, wherein the at least one outer coupled portion and the at least one inner coupled portion are positioned away from each other in a direction perpendicular to the second direction.

3. The connector as recited in claim 2, wherein:

the housing has a mating end which is configured to be mated with the mating connector; and in the first direction, the at least one outer coupled portion is positioned closer to the mating end than the at least one inner coupled portion is.

4. The connector as recited in claim 3, wherein in a third direction perpendicular to both the first direction and the second direction, the first portion is positioned closer to the pivot than the second portion is.

5. The connector as recited in claim 2, wherein:

the at least one coupling portion further has an extending portion;

the extending portion extends inward in the second direction from the at least one outer coupled portion;

the bridge portion has a plate-like shape intersecting with the second direction; and the bridge portion connects the extending portion and the at least one inner coupled portion with each other.

6. The connector as recited in claim 1, wherein the second portion is a hole which pierces the second housing in the second direction.

7. The connector as recited in claim 1, wherein:

the at least one coupling portion includes two of the coupling portions;

the at least one outer coupled portion includes two of the outer coupled portions;

the at least one inner coupled portion includes two of the inner coupled portions;

the coupling portions couple the outer coupled portions and the inner coupled portions, respectively, with each other; and the lever accommodating portion is positioned between the coupling portions in a third direction perpendicular to both the first direction and the second direction.

8. The connector as recited in claim 1, wherein:

the housing has a mating end which is configured to be mated with the mating connector;

the outer portion has a ditch;

the ditch extends so as to intersect with the first direction; and the ditch is positioned between the mating end and the pivot in the first direction.

9. The connector as recited in claim 8, wherein the ditch pierces the outer portion in the second direction.

10. The connector as recited in claim 1, wherein:

the connector comprises a terminal;

the first housing holds the terminal;

the second housing is attached to the first housing; and the outer coupled portion, the inner coupled portion and the coupling portion are provided on the second housing.

11. The connector as recited in claim 10, wherein:

the lever accommodating portion is provided between the first housing and the second housing in the second direction;

the pivot extends outward in the second direction;

the lever has a bearing, a pivot guide portion and an outer circumference portion;

the bearing is positioned away from the outer circumference portion in a direction perpendicular to the second direction;

the bearing is recessed in the second direction;

the bearing receives the pivot; and the pivot guide portion is a groove which extends from the outer circumference portion of the lever to the bearing of the lever in a direction perpendicular to the second direction.

12. The connector as recited in claim 11, wherein the pivot guide portion has a guide surface which intersects with a plane perpendicular to the second direction.

* * * * *